US009826576B2

(12) United States Patent
Yoshino et al.

(10) Patent No.: US 9,826,576 B2
(45) Date of Patent: Nov. 21, 2017

(54) INDUCTION HEATING COOKER

(71) Applicants: Hayato Yoshino, Tokyo (JP); Koshiro Takano, Tokyo (JP); Yuichiro Ito, Tokyo (JP); Kenichiro Nishi, Tokyo (JP)

(72) Inventors: Hayato Yoshino, Tokyo (JP); Koshiro Takano, Tokyo (JP); Yuichiro Ito, Tokyo (JP); Kenichiro Nishi, Tokyo (JP)

(73) Assignees: Mitsubishi Electric Corporation, Tokyo (JP); Mitsubishi Electric Home Appliance Co., Ltd., Saitama (JP)

( * ) Notice: Subject to any disclaimer, the term of this patent is extended or adjusted under 35 U.S.C. 154(b) by 329 days.

(21) Appl. No.: 14/431,860

(22) PCT Filed: Mar. 13, 2013

(86) PCT No.: PCT/JP2013/056916

§ 371 (c)(1),
(2) Date: Mar. 27, 2015

(87) PCT Pub. No.: WO2014/069011

PCT Pub. Date: May 8, 2014

(65) Prior Publication Data

US 2015/0245416 A1 Aug. 27, 2015

(30) Foreign Application Priority Data

Oct. 30, 2012 (WO) ..... PCT/JP2012/077944

(51) Int. Cl.
*H05B 6/06* (2006.01)
*H05B 6/12* (2006.01)

(52) U.S. Cl.
CPC ..... *H05B 6/062* (2013.01); *H05B 6/1209* (2013.01); *H05B 2213/07* (2013.01)

(58) Field of Classification Search
CPC combination set(s) only.
See application file for complete search history.

(56) References Cited

U.S. PATENT DOCUMENTS 3,949,183 A * 4/1976 Usami ..... H05B 6/1209 219/443.1
4,358,654 A * 11/1982 Estes ..... H02M 3/10 219/625

(Continued)

FOREIGN PATENT DOCUMENTS

JP S60-59693 A 4/1985
JP H05-062773 A 3/1993

(Continued)

OTHER PUBLICATIONS

Office Action dated Nov. 25, 2015 in the corresponding CN application No. 201380056999.5 (with English translation).

(Continued)

*Primary Examiner* — Anne M Antonucci
*Assistant Examiner* — Renee M Larose
(74) *Attorney, Agent, or Firm* — Posz Law Group, PLC

(57) ABSTRACT

When an inverter circuit is driven at a predetermined driving frequency, an amount of current change per predetermined period of time of an input current or a coil current is detected, and a heating period from a start of control until the amount of current change becomes a set value or less is measured. Then, the inverter circuit is controlled to reduce high frequency power to be supplied to a heating coil in accordance with a length of the measured heating period.

12 Claims, 15 Drawing Sheets

(56) References Cited

U.S. PATENT DOCUMENTS 4,467,162 A * 8/1984 Kondo ..... H05B 6/1209 219/622
4,540,866 A * 9/1985 Okuda ..... H05B 6/062 219/626
6,153,863 A * 11/2000 Snowball ..... H05B 6/062 219/626
6,320,169 B1 * 11/2001 Clothier ..... G06K 7/0008 219/620
6,630,650 B2 * 10/2003 Bassill ..... H05B 6/062 219/626
6,965,100 B2 * 11/2005 Kim ..... H05B 6/6423 219/702
7,173,224 B2 * 2/2007 Kataoka ..... H05B 6/062 219/620
7,420,828 B2 * 9/2008 Ishio ..... H05B 6/08 219/663
7,652,231 B2 * 1/2010 Kagan ..... H05B 6/04 219/663
7,767,941 B2 * 8/2010 Kagan ..... H05B 6/04 219/601
8,247,748 B2 * 8/2012 Watanabe ..... H05B 6/062 219/620
8,598,497 B2 * 12/2013 Broders ..... G05D 23/1902 219/412
8,754,351 B2 * 6/2014 England ..... H05B 6/062 219/620
8,803,048 B2 * 8/2014 Bassill ..... H05B 6/062 219/626
2003/0042254 A1 * 3/2003 Kim ..... H05B 6/6423 219/757
2003/0178416 A1 * 9/2003 Fujii ..... H05B 6/062 219/621
2004/0149736 A1 * 8/2004 Clothier ..... H05B 6/062 219/627
2004/0188426 A1 * 9/2004 Hirota ..... H05B 6/062 219/663
2005/0121438 A1 * 6/2005 Hirota ..... H05B 6/062 219/663
2006/0054617 A1 * 3/2006 Ryu ..... H05B 6/062 219/626
2006/0081607 A1 * 4/2006 Niiyama ..... H05B 6/062 219/497
2006/0081615 A1 * 4/2006 Kataoka ..... H05B 6/062 219/622
2006/0157478 A1 * 7/2006 Miyauchi ..... H05B 6/062 219/663
2007/0084857 A1 * 4/2007 Osaka ..... H05B 6/062 219/660
2007/0221664 A1 * 9/2007 Ito ..... H03K 17/962 219/622
2007/0263699 A1 * 11/2007 Clothier ..... G01K 7/36 374/163
2008/0049470 A1 * 2/2008 Ishio ..... H05B 6/062 363/78
2008/0073337 A1 * 3/2008 Haag ..... H05B 6/1209 219/622
2009/0134149 A1 * 5/2009 Keishima ..... H05B 6/062 219/647
2009/0194526 A1 * 8/2009 Buchanan ..... H05B 6/062 219/600
2010/0181299 A1 * 7/2010 Niiyama ..... H05B 6/062 219/620
2011/0000904 A1 * 1/2011 Sakakibara ..... H05B 6/062 219/624
2012/0061381 A1 * 3/2012 Hashimoto ..... H05B 6/062 219/620
2012/0263486 A1 * 10/2012 Aiko ..... G03G 15/2053 399/67
2012/0285946 A1 * 11/2012 Brosnan ..... H05B 6/062 219/621
2013/0008889 A1 * 1/2013 Ogasawara ..... H05B 6/062 219/622
2013/0140297 A1 * 6/2013 Okuda ..... H05B 6/062 219/627

FOREIGN PATENT DOCUMENTS

JP H08-330064 A 12/1996
JP H11-260542 A 9/1999
JP 2001-267052 A 9/2001
JP 2006-114311 A 4/2006
JP 2007-287702 A 11/2007
JP 2008-181892 A 8/2008
JP 2010035377 * 2/2010 ..... Y02B 10/50
JP 2010-257996 A 11/2010
JP 2011-014363 A 1/2011
JP 2011-216501 A 10/2011

OTHER PUBLICATIONS

Office Action dated Nov. 17, 2015 issued in corresponding JP patent application No. 2014-544332 (and English translation).
International Search Report of the International Searching Authority dated Apr. 16, 2013 for the corresponding international application No. PCT/JP2013/056916 (and English translation).

* cited by examiner

INDUCTION HEATING COOKER

CROSS REFERENCE TO RELATED APPLICATIONS

This application is a U.S. national stage application of PCT/JP2013/056916 filed on Mar. 13, 2013, which is based on and claims priority from PCT/JP2012/077944 filed on Oct. 30, 2012, the contents of which are incorporated herein by reference.

TECHNICAL FIELD

The present invention relates to an induction heating cooker.

BACKGROUND

Related-art induction heating cookers include ones that determine the temperature of the heating target based on an input current or a controlled variable of an inverter (see, for example, Patent Literatures 1 and 2). The induction heating cooker described in Patent Literature 1 includes the control means for controlling the inverter so that the input current of the inverter becomes constant, and in a case where the controlled variable changes by the predetermined amount or more in the predetermined period of time, it is determined that the change in temperature of the heating target is large to suppress the output of the inverter. It is also disclosed that, in a case where the change in controlled variable becomes the predetermined amount or less in the predetermined period of time, it is determined that water boiling has finished, and the driving frequency is reduced to reduce the output of the inverter.

Patent Literature 2 proposes the induction heating cooker including input current change amount detecting means for detecting the amount of change in input current, and temperature determination processing means for determining the temperature of the heating target based on the amount of change in input current, which is detected by the input current change amount detecting means. It is disclosed that, in a case where the temperature determination processing means determines that the heating target has reached the boiling temperature, the stop signal is output to stop heating.

PATENT LITERATURE

Patent Literature 1: Japanese Unexamined Patent Application Publication No. 2008-181892 (paragraph 0025 and FIG. 1)

Patent Literature 2: Japanese Unexamined Patent Application Publication No. Hei 5-62773 (paragraph 0017 and FIG. 1)

However, in the case of just stopping when the predetermined temperature is reached as in the induction heating cookers described in Patent Literatures 1 and 2, there has been a problem in that a temperature control suitable for the heating target cannot be performed after the heating target is heated. More specifically, in a case where the heating target is to be kept at a predetermined temperature (for example, boiled state), a quantity of heat to be supplied is different depending on the type, the volume, and the like of the heating target. In a case where the amount of the heating target is small and a large quantity of heat is supplied, electric power is wasted, and in a case where the amount of the heating target is large and a quantity of heat that is appropriate thereto is not supplied, the heating target cannot be kept at the predetermined temperature.

SUMMARY

The present invention has been made in order to solve the above-mentioned problems, and therefore has an object to provide an induction heating cooker capable of performing optimal operation efficiently depending on the type, the volume, and the like of the heating target after the heating target is heated.

According to one embodiment of the present invention, there is provided an induction heating cooker, including: a heating coil configured to inductively heat the heating target; an inverter circuit configured to supply high frequency power to the heating coil; and a controller configured to control driving of the inverter circuit with a drive signal, the controller including: driving frequency setting means for setting driving frequency of the drive signal in heating the heating target; current change amount detecting means for detecting whether or not an amount of current change per predetermined period of time of an input current to the inverter circuit or a coil current flowing through the heating coil has become a set amount of current change, which is set in advance, or less; period measuring means for measuring a heating period from a start of power supply to the heating coil until the amount of current change becomes the set amount of current change or less; and drive control means for controlling the inverter circuit so that the high frequency power is supplied to the heating coil in accordance with a length of the heating period measured by the period measuring means.

According to one embodiment of the present invention, the electric power is controlled depending on the heating period from the start of the heating until becoming the set amount of current change or less, with the result that the energy-saving and easy-to-use induction heating cooker, which is capable of performing the heat retaining operation while suppressing wasteful power supply, may be provided.

DETAILED DESCRIPTION

Embodiment 1

Configuration

Figure 1:
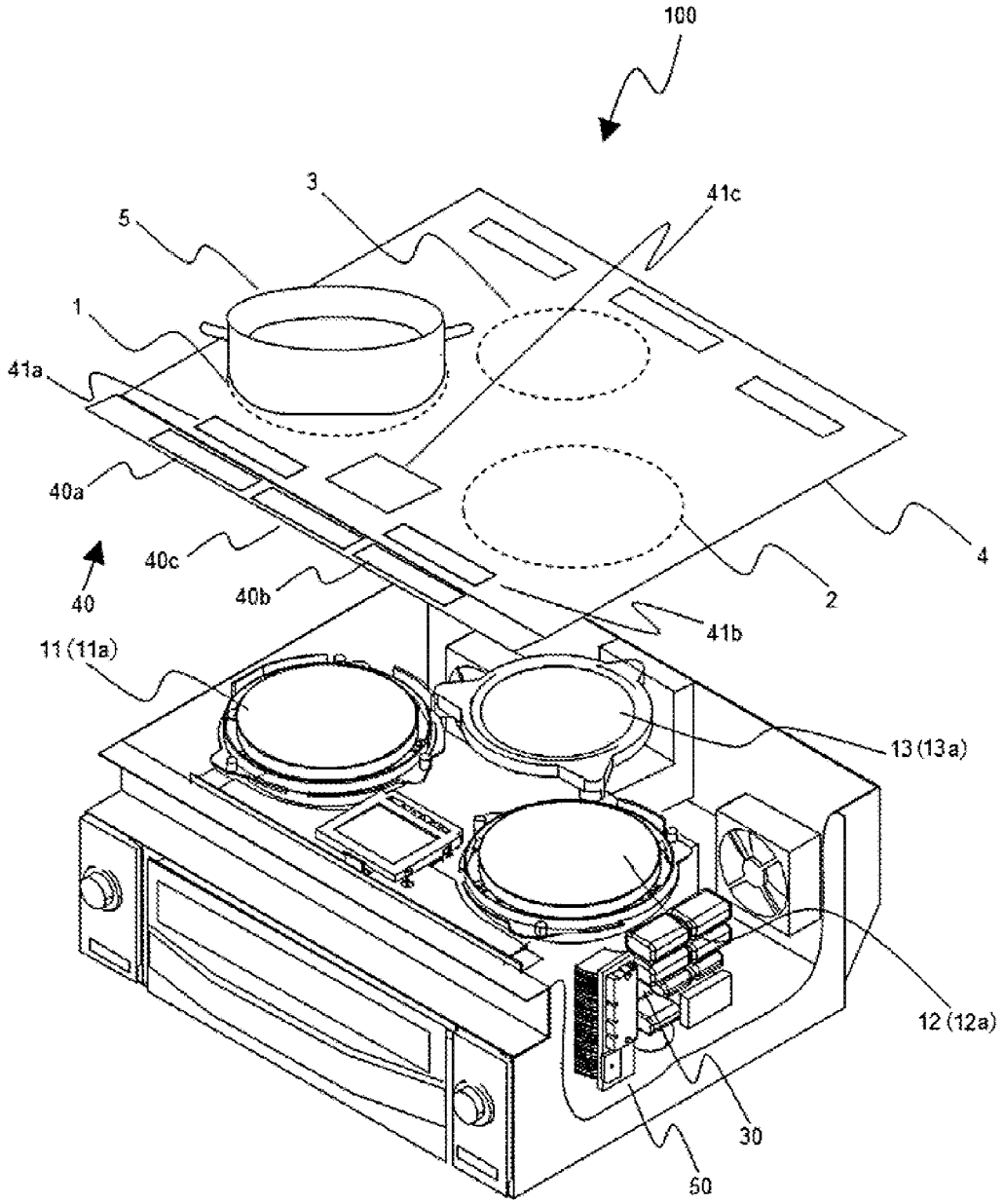
FIG. 1 is an exploded perspective view illustrating Embodiment 1 of an induction heating cooker according to the present invention.

FIG. 1 is an exploded perspective view illustrating Embodiment 1 of an induction heating cooker according to the present invention. As illustrated in FIG. 1, an induction heating cooker 100 includes on its top a top plate 4, on which the heating target 5 such as a pot is placed. In the top plate 4, a first heating port 1, a second heating port 2, and a third heating port 3 are provided as heating ports for inductively heating the heating target 5. The induction heating cooker 100 also includes first heating means 11, second heating means 12, and third heating means 13 respectively corresponding to the heating ports 1 to 3, and the heating target 5 may be placed on each of the heating ports 1 to 3 to be inductively heated.

In FIG. 1, the first heating means 11 and the second heating means 12 are provided to be arranged to the right and left on a front side of a main body, and the third heating means 13 is provided substantially at the center on a back side of the main body.

Note that, the arrangement of the heating ports 1 to 3 is not limited thereto. For example, the three heating ports 1 to 3 may be arranged side by side in a substantially linear manner. Moreover, an arrangement in which a center of the first heating means 11 and a center of the second heating means 12 are at different positions in a depth direction may be adopted.

The top plate 4 is entirely formed of a material that transmits infrared ray, such as heat-resistant toughened glass or crystallized glass, and is fixed to the main body of the induction heating cooker 100 via rubber packing or a sealing material in a watertight state with a periphery of a top opening. In the top plate 4, circular pot position indicators indicating general placement positions of pots are formed by applying paints, printing, or the like to correspond to heating ranges (heating ports 1 to 3) of the first heating means 11, the second heating means 12, and the third heating means 13.

On a front side of the top plate 4, an operation unit 40*a*, an operation unit 40*b*, and an operation unit 40*c* (hereinafter, sometimes collectively referred to as "operation unit 40") are provided as input devices for setting heating power and cooking menus (water boiling mode, fryer mode, and the like) for heating the heating target 5 by the first heating means 11, the second heating means 12, and the third heating means 13. Moreover, in the vicinity of the operation unit 40, a display unit 41*a*, a display unit 41*b*, and a display unit 41*c* for displaying an operating state of the induction heating cooker 100, input and operation details from the operation unit 40, and the like are provided as announcing means 41. Note that, the present invention is not particularly limited to the case where the operation units 40*a* to 40*c* and the display units 41*a* to 41*c* are respectively provided for the heating ports 1 to 3 or a case where the operation unit 40 and the display unit are provided collectively for the heating ports 1 to 3.

Below the top plate 4 and inside the main body, the first heating means 11, the second heating means 12, and the third heating means 13 are provided, and the heating means 11 to 13 include heating coils 11*a* to 13*a*, respectively.

Inside the main body of the induction heating cooker 100, a drive circuit 50 for supplying high frequency power to each of the heating coils 11*a* to 13*a* of the heating means 11 to 13, and a controller 30 for controlling operation of the entire induction heating cooker 100 including the drive circuit 50 are provided.

Each of the heating coils 11*a* to 13*a* has a substantially circular planar shape, and is configured by winding a conductive wire, which is made of an arbitrary insulation-coated metal (for example, copper, aluminum, or the like), in a circumferential direction. Then, each of the heating coils 11*a* to 13*a* heats the heating target 5 by an induction heating operation when supplied with the high frequency power from the drive circuit 50.

Figure 2:
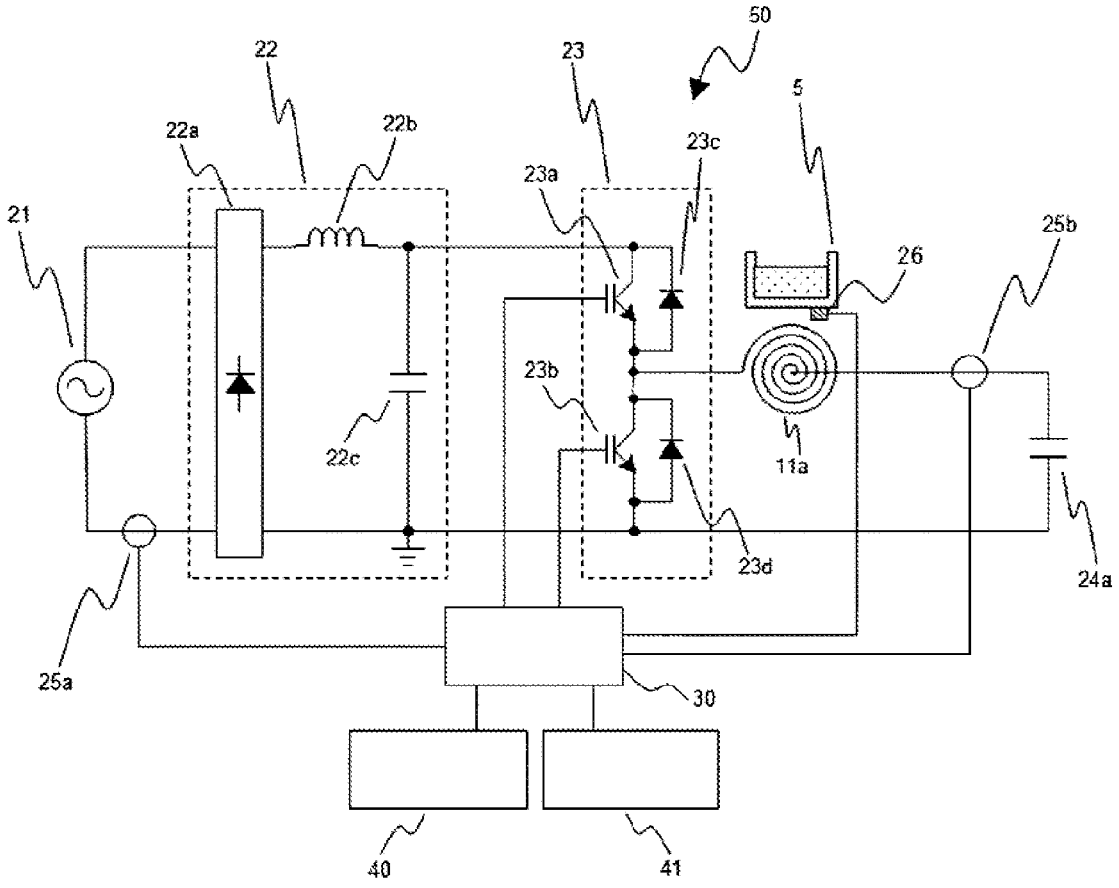
FIG. 2 is a schematic diagram illustrating an example of a drive circuit of the induction heating cooker of FIG. 1.

FIG. 2 is a schematic diagram illustrating an example of the drive circuit 50 of the induction heating cooker 100 in FIG. 1. FIG. 2 illustrates the drive circuit 50 for the heating coil 11*a* in a case where the drive circuit 50 is provided for each of the heating means 11 to 13. The circuit configuration may be the same for the respective heating means 11 to 13, or may be changed for each of the heating means 11 to 13. The drive circuit 50 in FIG. 2 includes a DC power supply circuit 22, an inverter circuit 23, and a resonant capacitor 24*a*.

The DC power supply circuit 22 is configured to convert an AC voltage, which is input from an AC power supply 21, into a DC voltage to be output to the inverter circuit 23, and includes a rectifier circuit 22*a*, which is formed of a diode bridge or the like, a reactor (choke coil) 22*b*, and a smoothing capacitor 22*c*. Note that, the configuration of the DC power supply circuit 22 is not limited to the above-mentioned configuration, and various well-known techniques may be used.

The inverter circuit 23 is configured to convert DC power, which is output from the DC power supply circuit 22, into high-frequency AC power, and supply the high-frequency AC power to the heating coil 11*a* and the resonant capacitor 24*a*. The inverter circuit 23 is an inverter of a so-called half bridge type in which switching elements 23*a* and 23*b* are connected in series with the output of the DC power supply circuit 22, and diodes 23*c* and 23*d* as flywheel diodes are connected in parallel to the switching elements 23*a* and 23*b*, respectively.

The switching elements 23*a* and 23*b* are formed of, for example, silicon-based IGBTs. Note that, the switching elements 23*a* and 23*b* may be formed of wide bandgap semiconductors made of silicon carbide, a gallium nitride-based material, or the like. The wide bandgap semiconductors may be used for the switching elements 23*a* and 23*b* to reduce feed losses in the switching elements 23*a* and 23*b*. Moreover, even when a switching frequency (driving frequency) is set to a high frequency (high speed), the drive circuit radiates heat satisfactorily, with the result that a radiator fin for the drive circuit may be made small, and that reductions in size and cost of the drive circuit 50 may be realized. Note that, the case where the switching elements 23*a* and 23*b* are IGBTs is exemplified, but the present invention is not limited thereto, and MOSFETs and other such switching elements may be used.

Operation of the switching elements 23*a* and 23*b* is controlled by the controller 30, and the inverter circuit 23 outputs the high-frequency AC power of about 20 kilohertz (kHz) to 50 kilohertz (kHz) in accordance with the driving frequency, which is supplied from the controller 30 to the switching elements 23*a* and 23*b*. Then, a high frequency current of about several tens of amperes (A) flows through the heating coil 11*a*, and the heating coil 11*a* inductively heats the heating target 5, which is placed on the top plate 4 immediately thereabove, by a high frequency magnetic flux generated by the high frequency current flowing therethrough.

To the inverter circuit 23, a resonant circuit including the heating coil 11*a* and the resonant capacitor 24*a* is connected. The resonant capacitor 24*a* is connected in series with the heating coil 11*a*, and the resonant circuit has a resonant frequency corresponding to an inductance of the heating coil 11*a*, a capacitance of the resonant capacitor 24*a*, and the like. Note that, the inductance of the heating coil 11*a* changes in accordance with characteristics of the heating target 5 (metal load) when the metal load is magnetically coupled, and the resonant frequency of the resonant circuit changes in accordance with the change in inductance.

Further, the drive circuit 50 includes input current detecting means 25*a*, coil current detecting means 25*b*, and temperature sensing means 26. The input current detecting means 25*a* detects an electric current, which is input from the AC power supply (commercial power supply) 21 to the DC power supply circuit 22, and outputs a voltage signal, which corresponds to an input current value, to the controller 30.

The coil current detecting means 25*b* is connected between the heating coil 11*a* and the resonant capacitor 24*a*. The coil current detecting means 25*b* detects an electric current flowing through the heating coil 11*a*, and outputs a voltage signal, which corresponds to a heating coil current value, to the controller 30.

The temperature sensing means 26 is formed, for example, of a thermistor, and detects a temperature based on heat transferred from the heating target 5 to the top plate 4. Note that, the temperature sensing means 26 is not limited to the thermistor, and any sensor such as an infrared sensor may be used. Temperature information sensed by the temperature sensing means 26 may be utilized to obtain the induction heating cooker 100 with higher reliability.

Figure 3:
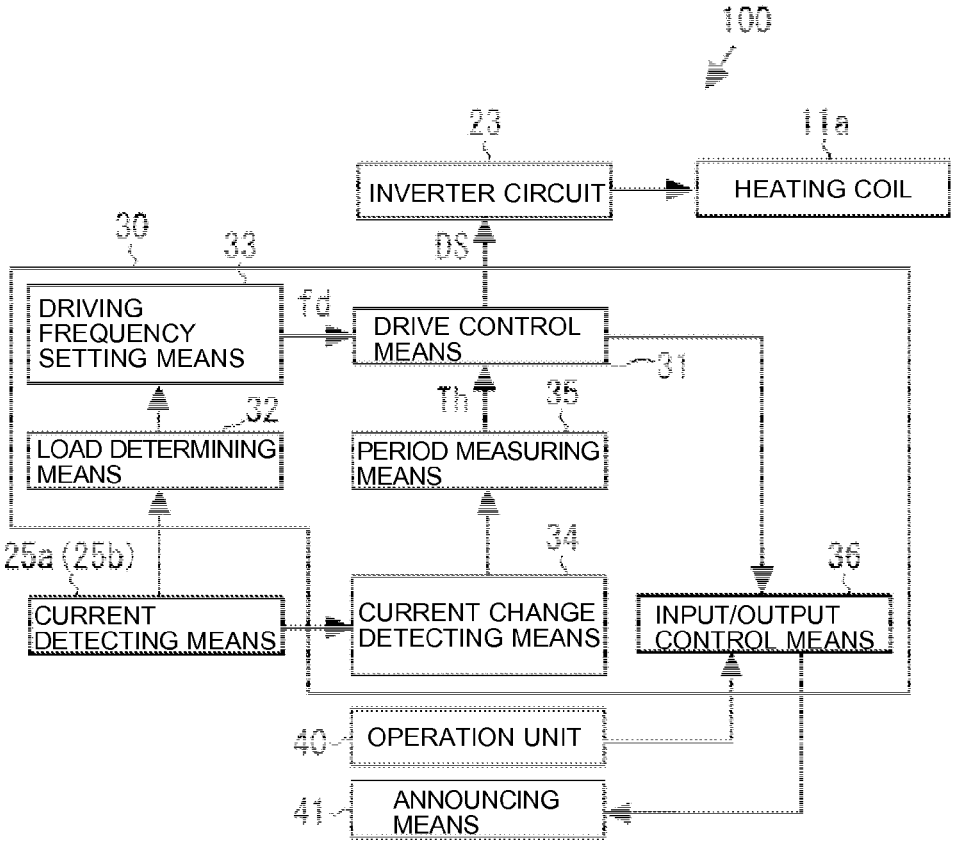
FIG. 3 is a functional block diagram illustrating an example of a controller in the induction heating cooker of FIG. 1.

FIG. 3 is a functional block diagram illustrating a configuration of the controller 30 in the induction heating cooker 100 of FIG. 2, and the controller 30 is described with reference to FIG. 3. The controller 30 of FIG. 3, which is constructed by a microcomputer, a digital signal processor (DSP), or the like, is configured to control the operation of the induction heating cooker 100, and includes drive control means 31, load determining means 32, driving frequency setting means 33, current change detecting means 34, period measuring means 35, and input/output control means 36.

The drive control means 31 outputs drive signals DS to the switching elements 23*a* and 23*b* of the inverter circuit 23 to cause the switching elements 23*a* and 23*b* to perform switching operation and thereby drive the inverter circuit 23. Then, the drive control means 31 controls the high frequency power, which is supplied to the heating coil 11*a*, to control heating to the heating target 5. Each of the drive signals DS is, for example, a signal having a predetermined driving frequency of about 20 to 50 kilohertz (kHz) with a predetermined ON duty ratio (for example, 0.5).

The load determining means 32 is configured to perform load determination processing on the heating target 5, and determines a material of the heating target 5 as a load. Note that, the load determining means 32 determines the material of the heating target 5 (pot), which serves as the load, by broadly dividing the material into, for example, a magnetic material such as iron or SUS 430, a high-resistance non-magnetic material such as SUS 304, and a low-resistance non-magnetic material such as aluminum or copper.

Figure 4:
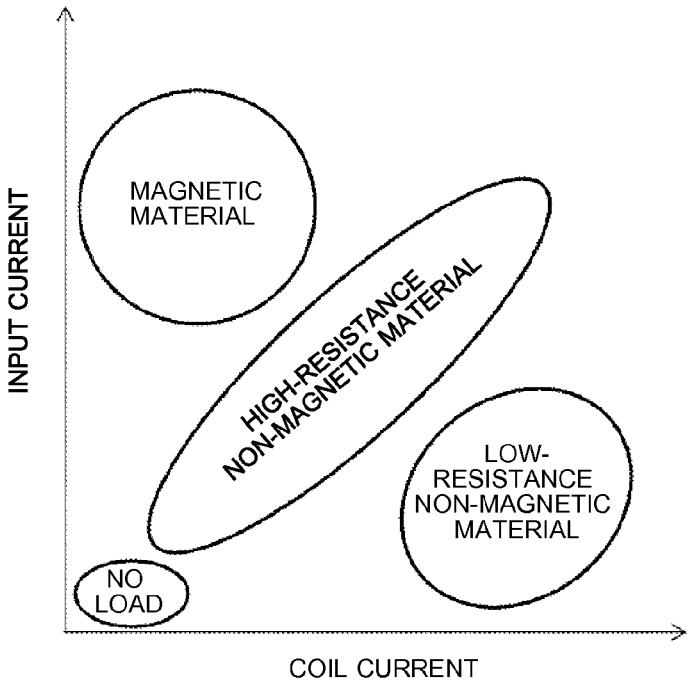
FIG. 4 is a graph showing an example of a load determination table storing a relationship of a coil current and an input current in load determining means of FIG. 3.

The load determining means 32 has a function of using a relationship of an input current and a coil current to determine a load of the heating target 5 described above. FIG. 4 is a graph showing an example of a load determination table of the heating target 5 based on the relationship of the coil current flowing through the heating coil 11*a* and the input current. As shown in FIG. 4, the relationship of the coil current and the input current is different for the material (pot load) of the heating target 5 placed on the top plate 4.

The load determining means 32 stores the load determination table, which expresses in a table form a correlation between the input current and the coil current, which is shown in FIG. 4. Then, when a drive signal for determining the load is output from the drive control means 31 to drive the inverter circuit 23, the load determining means 32 detects the input current from an output signal of the input current detecting means 25*a*. At the same time, the load determining means 32 detects the coil current from an output signal of the coil current detecting means 25*b*. The load determining means 32 determines the material of the heating target (pot) 5, which has been placed, from the load determination table of FIG. 4 based on the coil current and the input current, which have been detected. In this manner, the load determination table may be stored inside to construct the load determining means 32, which determines the load automatically with an inexpensive configuration.

Note that, in a case where the load determining means 32 of FIG. 3 determines that the heating target 5 is made of the low-resistance non-magnetic material, it is determined that the heating target 5 cannot be heated by the induction heating cooker 100. Then, the input/output control means 36 controls the announcing means 41 to output the message and prompt a user to change the pot. At this time, the control is performed so as not to supply the high frequency power from the drive circuit 50 to the heating coil 11*a*. Moreover, in a case where the load determining means 32 determines a no-load state, the input/output control means 36 controls the announcing means 41 to announce that the heating cannot be performed, to thereby prompt the user to place a pot. Also in this case, the control is performed so as not to supply the high frequency power to the heating coil 11*a*. On the other hand, in a case where the load determining means 32 determines that the heating target 5 is made of the magnetic material or the high-resistance non-magnetic material, it is determined that those pots are made of materials that can be heated by the induction heating cooker 100.

The driving frequency setting means 33 is configured to set driving frequency f of the drive signals DS to be output to the inverter circuit 23 when supplying from the inverter circuit 23 to the heating coil 11*a*. In particular, the driving frequency setting means 33 has a function of automatically setting the driving frequency f in accordance with a determination result of the load determining means 32. More specifically, the driving frequency setting means 33 stores, for example, a table for determining the driving frequency f in accordance with the material of the heating target 5 and the set heating power. Then, when input with a result of the load determination and the set heating power, the driving frequency setting means 33 refers to the table to determine a value fd of the driving frequency f. Note that, the driving frequency setting means 33 sets frequency that is higher than the resonant frequency (driving frequency fmax in FIG. 5) of the resonant circuit so that the input current does not become too large.

In this manner, the driving frequency setting means 33 drives the inverter circuit 23 with the driving frequency f corresponding to the material of the heating target 5 based on the load determination result, with the result that an increase in input current may be suppressed, and hence the increase in temperature of the inverter circuit 23 may be suppressed to enhance reliability.

Figure 5:
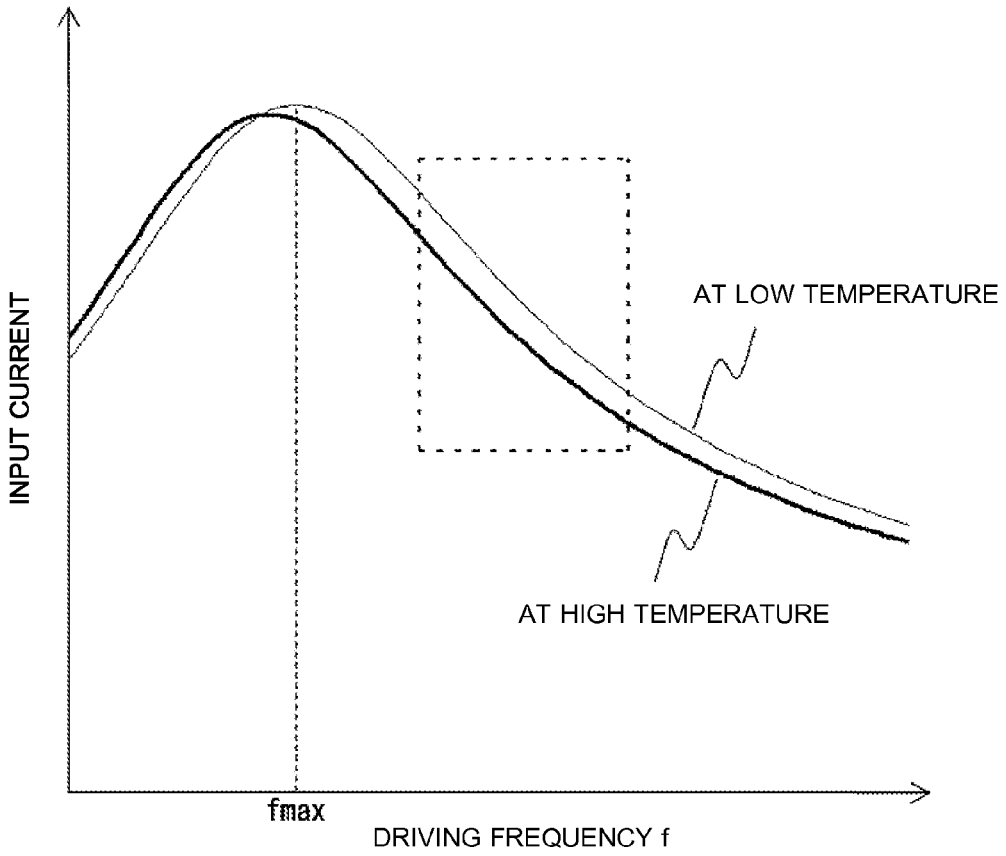
FIG. 5 is a graph showing how the input current in response to driving frequency of a drive circuit of FIG. 3 is changed by a change in temperature of the heating target.

The current change detecting means 34 is configured to detect, when the inverter circuit 23 is driven with the driving frequency f=fd set in the driving frequency setting means 33, an amount of current change Δ1 in input current per predetermined period of time. FIG. 5 is a graph showing a relationship of the input current with respect to the driving frequency f at a time of a temperature change of the heating target 5. Note that, in FIG. 5, the thin line indicates characteristics when the heating target 5 has a low temperature, and the thick line indicates characteristics when the heating target 5 has a high temperature. As shown in FIG. 5, the input current changes depending on the temperature of the heating target 5. The characteristics change because the heating target 5, which is formed of a metal, changes in electric resistivity and magnetic permeability along with the temperature change, which leads to a change in load impedance in the drive circuit 50. Note that, the predetermined period of time may be a period that is set in advance, or may be a period that can be changed by an operation of the operation unit 40.

Figure 6:
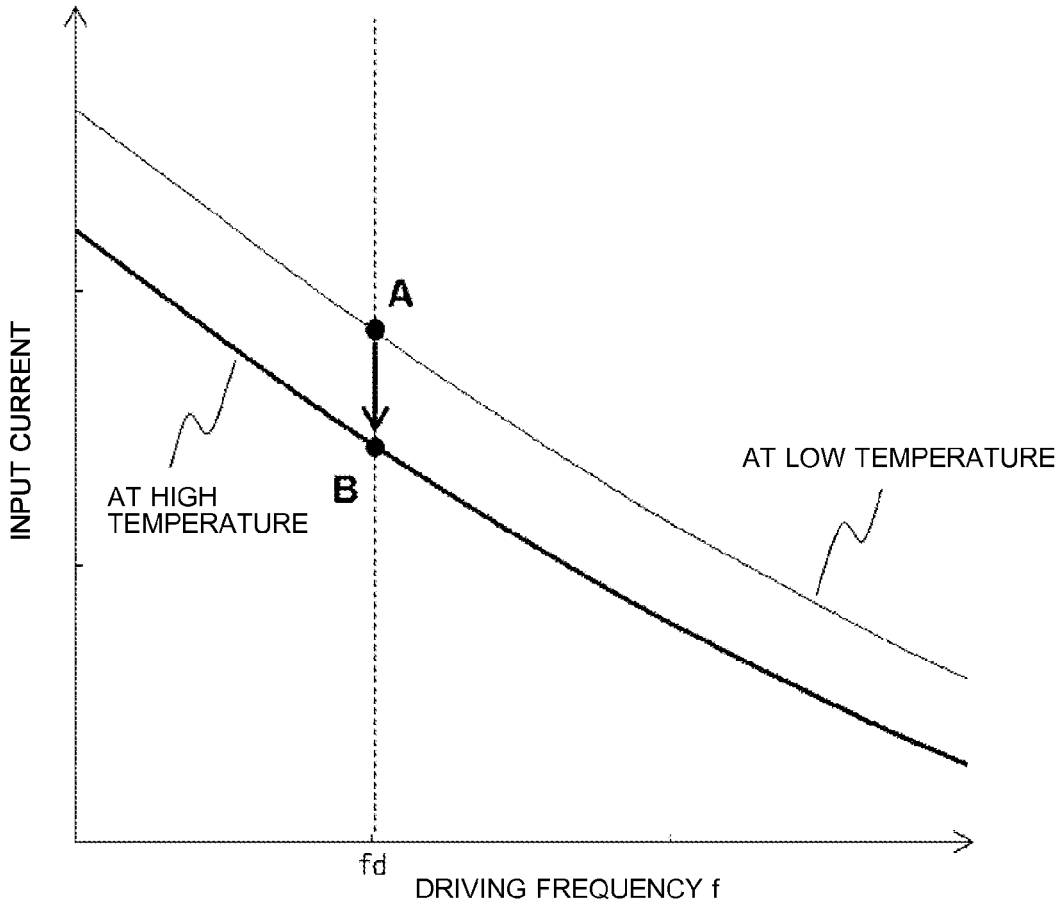
FIG. 6 is a graph obtained by enlarging a part shown with the broken line in the graph of FIG. 5.

FIG. 6 is a graph obtained by enlarging a part shown with the broken line in FIG. 5. As described above, when the inverter circuit 23 is driven in a state in which the driving frequency f is fixed to fd as shown in FIG. 6 in order to drive the driving frequency at frequency that is higher than fmax, the input current is gradually reduced along with an increase in temperature of the heating target 5, and the input current (operating point) changes from point A to point B as the temperature of the heating target 5 changes from low to high. Note that, in the state in which the driving frequency f is fixed to fd, an ON duty (ON/OFF ratio) of the switching elements of the inverter circuit 23 is also set to a fixed state.

Figure 7:
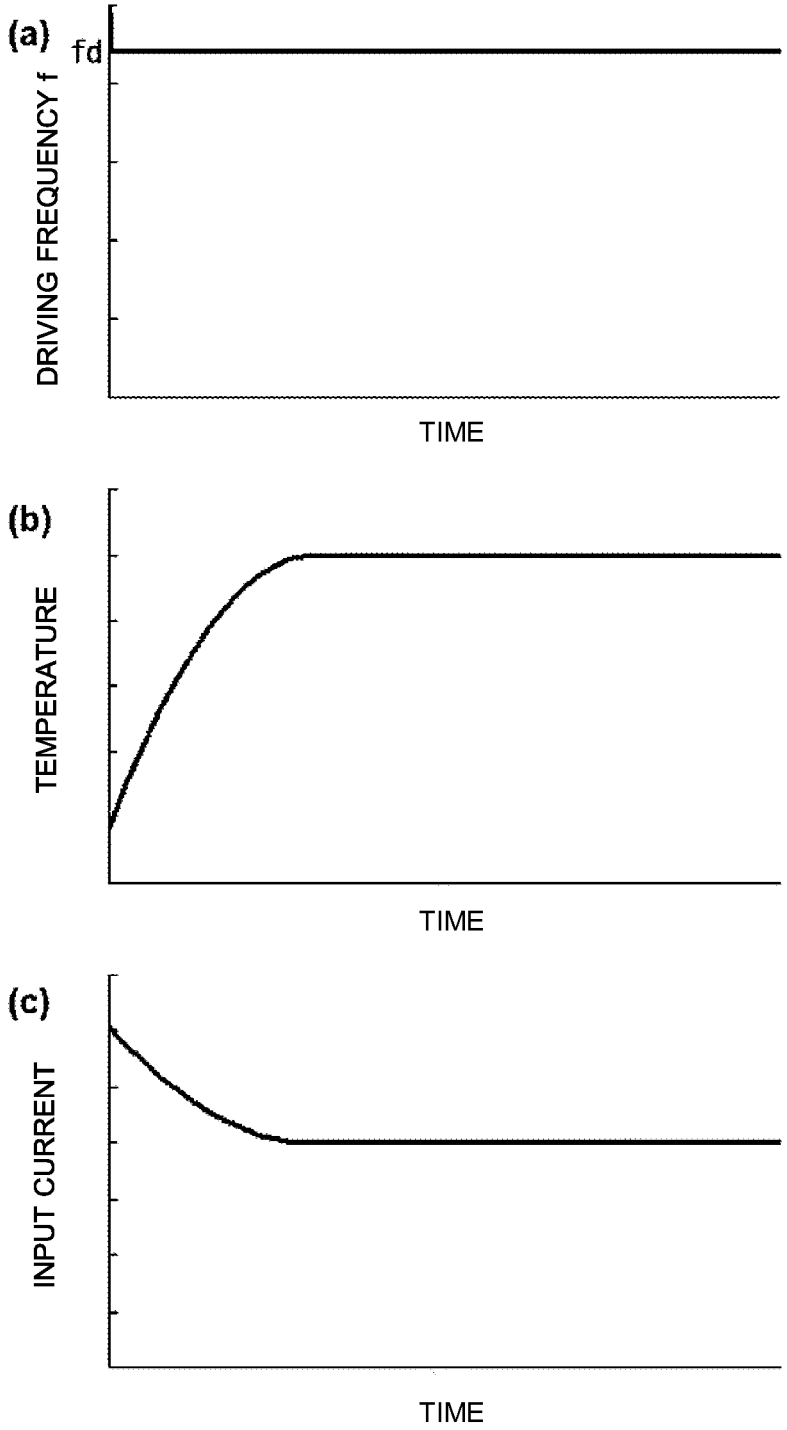
FIG. 7 is a graph showing a temperature and the input current with an elapse of time when the drive circuit of FIG. 3 is driven with a predetermined driving frequency.

FIG. 7 is a graph showing changes over time in the temperature of the heating target 5 and the input current when the heating target 5 contains water as content and is heated in the state in which the driving frequency f is fixed. In a case where the heating is performed with the driving frequency f being fixed as in part (a) of FIG. 7, the temperature (water temperature) of the heating target 5 gradually increases until boiling as shown in part (b) of FIG. 7. Moreover, along with the increase in temperature of the heating target 5, the input current is gradually reduced as shown in part (c) of FIG. 7 (see FIG. 6).

Then, an amount of temperature change is reduced as the water reaches a boiling point, and the amount of change in input current is reduced accordingly. When the water becomes a boiled state, the amount of temperature change and the amount of current change ΔI become very small. Therefore, the current change detecting means 34 in FIG. 3 is configured to determine, when the amount of current change ΔI of the input current becomes a set amount of current change ΔIref (for example, the amount of current change becomes 3 percent (%) of the input current) or less, that the heating target 5 has reached a predetermined temperature and the boiling (water boiling) has finished.

As described above, to detect the amount of current change ΔI means to detect the temperature of the heating target 5. The change in temperature of the heating target 5 is detected based on the amount of current change ΔI, with the result that the change in temperature of the heating target 5 may be detected regardless of the material of the heating target 5. Moreover, the change in temperature of the heating target 5 may be detected based on the change in input current, with the result that the change in temperature of the heating target 5 may be detected at high speed as compared to a temperature sensor or the like.

The period measuring means 35 is configured to measure a heating period Th from the start of the power supply to the heating coil 11*a* until the amount of current change ΔI becomes the set amount of current change ΔIref or less in the current change detecting means 34. Then, the drive control means 31 reduces the electric power to be supplied to the heating coil 11*a* depending on a length of the heating period Th measured by the period measuring means 35. The drive control means 31 resets the fixation of the driving frequency f=fd, and increases the driving frequency f by an increment amount Δf(f=fd+Δf) to drive the inverter circuit 23.

In particular, the drive control means 31 is configured to change the increment amount Δf depending on the length of the heating period Th, and sets the increment amount Δf smaller as the heating period Th becomes longer. Note that, the drive control means 31 stores a table indicating a relationship of the heating period Th and the increment amount Δf in advance, and the drive control means 31 refers to the table to determine the increment amount Δf.

Figure 8:
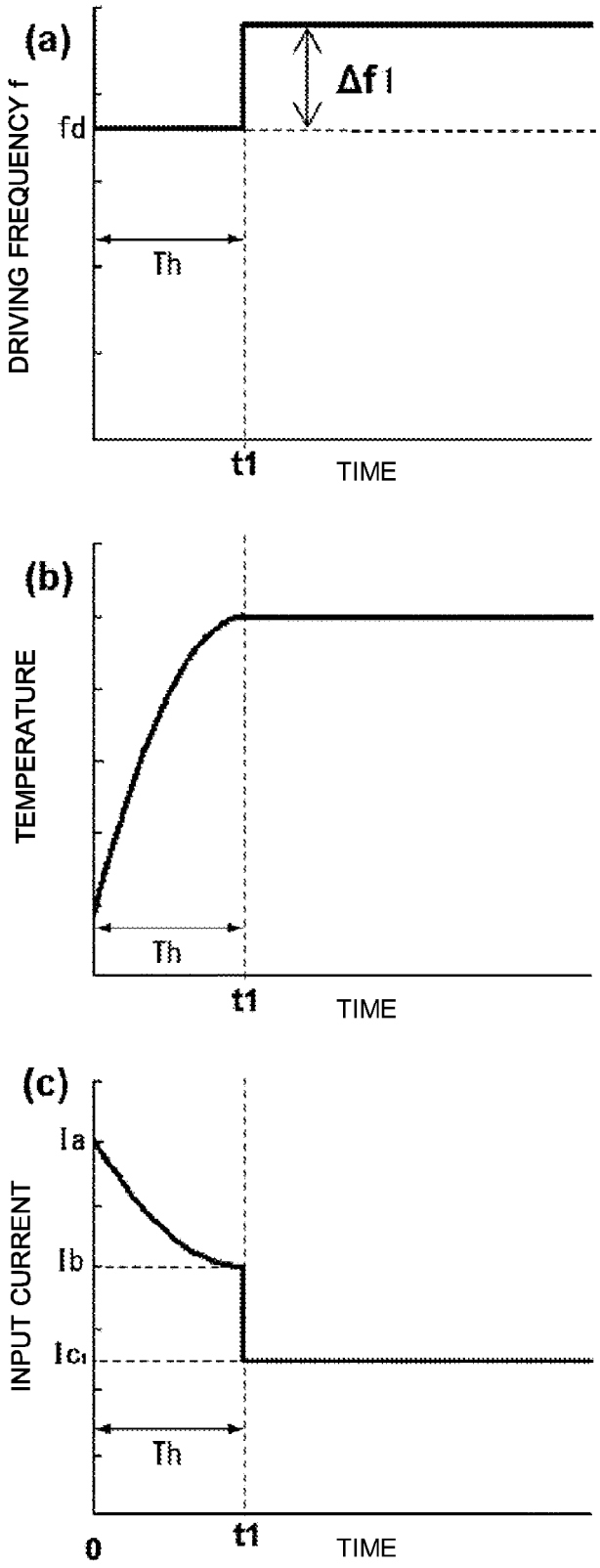
FIG. 8 is a graph showing a relationship of the temperature and the input current when the drive circuit of FIG. 3 drives at the predetermined driving frequency and a changed driving frequency.
Figure 9:
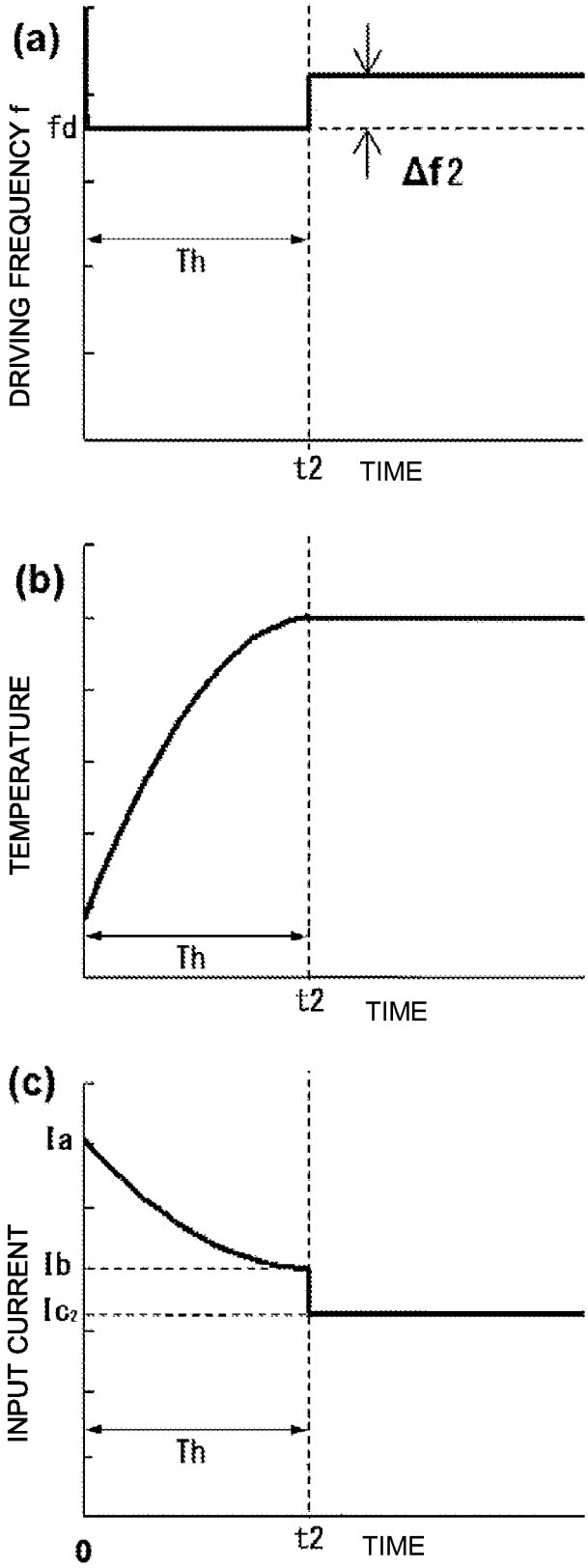
FIG. 9 is a graph showing a relationship of the temperature and the input current when the drive circuit of FIG. 3 drives at the predetermined driving frequency and the changed driving frequency.

FIGS. 8 and 9 are graphs each showing an example of changes over time in respective characteristics (the driving frequency f, the temperature, and the input current) when water is put in the heating target 5 and boiled. Note that, FIGS. 8 and 9 show the characteristics when water is contained in the heating target 5 which is made of the same material, at a time of the water boiling mode, and FIG. 9 shows the characteristics in a case where an amount of water is larger than in FIG. 8.

As shown in part (a) of FIG. 8, when the heating is started with the driving frequency f being fixed to fd, the temperature (water temperature) of the heating target 5 gradually increases until boiling as shown in part (b) of FIG. 8. In fixed driving frequency control, the input current value and hence the input current is gradually reduced as shown in part (c) of FIG. 8 along with the increase in temperature of the heating target 5. Moreover, as shown in parts (b) and (c) of FIG. 8, the amount of current change ΔI is reduced as the temperature increases.

Then, in a case where the amount of current change ΔI of the input current becomes the set amount of current change ΔIref or less at time t1, the current change detecting means 34 determines that the water boiling has finished, and the period measuring means 35 measures the heating period Th from the start of the power supply until time t1 at which the amount of current change ΔI becomes the set amount of current change ΔIref or less.

Here, as shown in parts (a) to (c) of FIG. 9, in a case where the volume (amount of water) in the heating target 5 is large, the heating period Th until time t2 when the amount of current change ΔI becomes the set amount of current change ΔIref or less is longer than the heating period Th (time t1) in FIG. 8 (t2≥t1). The heating period Th until the amount of current change ΔI of the input current becomes the set amount of current change ΔIref or less is different depending on the amount of water in the heating target 5, and as the volume (amount of water) in the heating target 5 becomes larger, the heating period Th becomes longer. Note that, the case where the volume of water is different in the water boiling mode is exemplified, but also in a mode other than the water boiling mode, the heating period Th is different for the type of the content in the heating target 5 in a case where the type is different.

Here, when keeping the temperature in a predetermined temperature state (boiled state) after heating in the state in which the driving frequency f is fixed to fd, the drive control means 31 outputs the drive signals DS having the driving frequency f=fd+Δf, which is obtained by increasing the driving frequency f by the increment amount Δf. In other words, when keeping the temperature of the heating target 5, such heating power as to increase the temperature is not necessary, and hence an amount of heat applied from the heating coil 11*a* to the heating target 5 is suppressed. Therefore, in the case where the heating period Th is short as in FIG. 8, the driving frequency f is increased by a large amount to drive the inverter circuit 23 with the drive signals DS having the driving frequency f=fd+Δf1. On the other hand, in the case where the heating period Th is long as in FIG. 9, the driving frequency f is increased by a small amount to drive the inverter circuit 23 with the drive signals DS having the driving frequency f=fd+Δf2.

Figure 10:
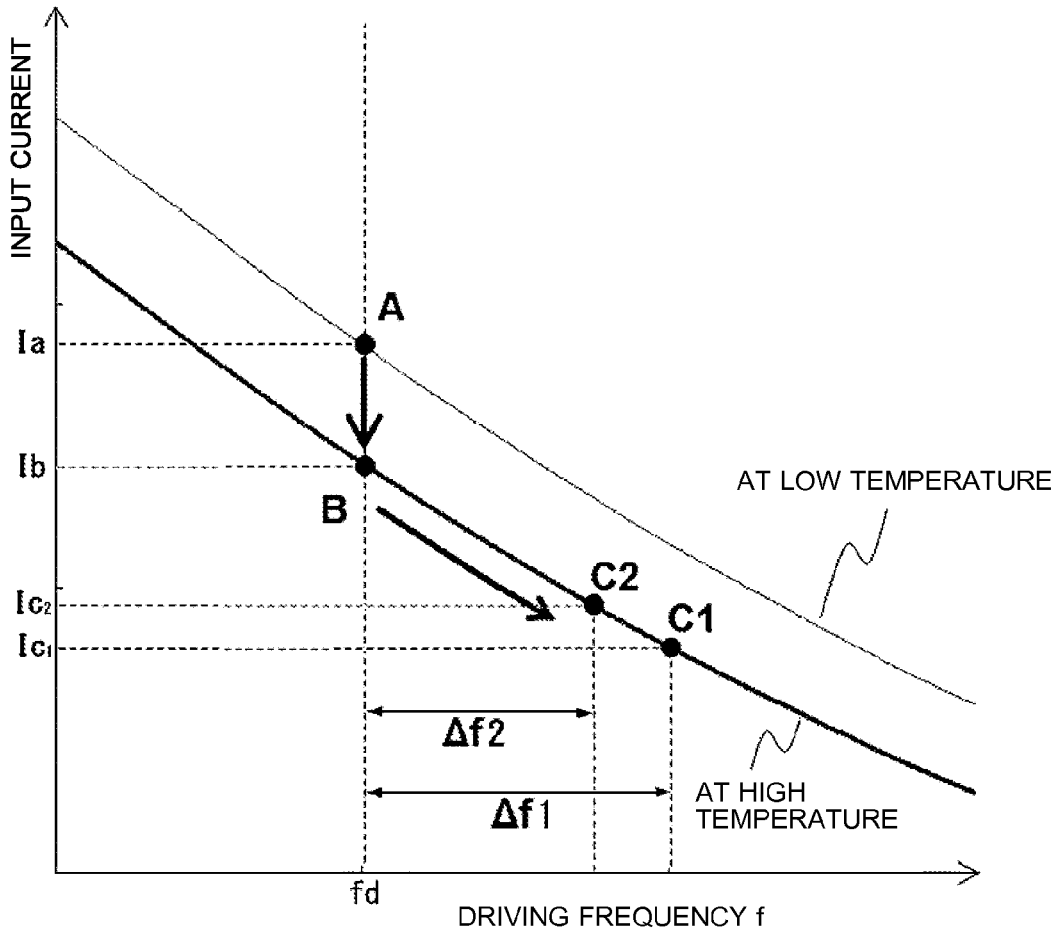
FIG. 10 is a graph obtained by enlarging the part shown with the broken line in the graph of FIG. 5.

FIG. 10 is a graph showing a relationship of the increment amount of the driving frequency f and the input current (heating power). As shown in FIG. 10, when the heating operation is performed in the state in which the driving frequency f is fixed to fd, input power changes from a current value Ia at point A to a current value Ib at point B. Then, at point B, in the case where the amount of current change ΔI becomes the set amount of current change ΔIref or less, the drive control means 31 determines an increment amount Δf1 (see FIG. 8) or an increment amount Δf2 (see FIG. 9) depending on the length of the heating period Th.

At this time, the increment amounts Δf1 and Δf2 are set so that even when the driving frequency f is increased to reduce the heating power, the water temperature is hardly reduced to keep a constant temperature, and the operating point changes from point B to point C1 (or point C2). Then, in the case where the inverter circuit 23 is driven with the drive signals DS having the driving frequency f=fd+Δf1, the input current takes a current value Ic1. On the other hand, in the case where the inverter circuit 23 is driven with the drive signals DS having the driving frequency f=fd+Δf2, the input current takes a current value Ic2 (>Ic1). Then, even when the driving frequency f is increased to reduce the heating power, the water temperature is hardly reduced to keep a heat retaining state.

As described above, for the high frequency power (heating power) to be applied in and after the heating period Th, the heating power is set relatively high in the case where the heating period Th is long, and the heating power is set relatively low in the case where the heating period Th is short, with the result that the energy-saving and easy-to-use induction heating cooker, which is capable of performing the heat retaining operation while suppressing wasteful power supply, may be obtained. In particular, in the case of the water boiling (boiling of water) mode, the water temperature never becomes 100 degrees Centigrade or more even when the heating power is increased unnecessarily, and hence the boiled state may be maintained even when the driving frequency f is increased to reduce the heating power.

OPERATION EXAMPLE

Figure 11:
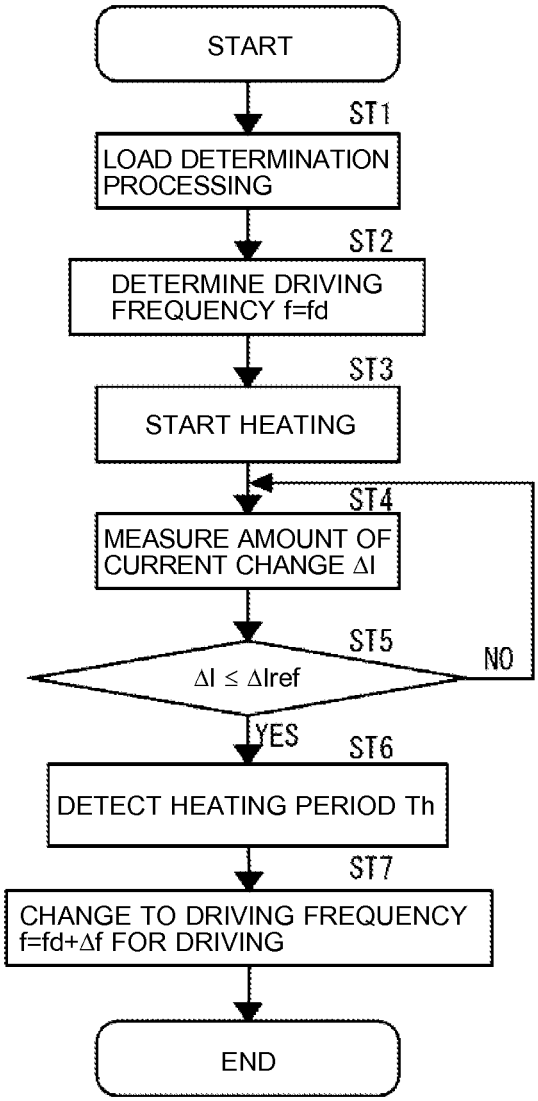
FIG. 11 is a flow chart illustrating an operation example of the induction heating cooker of FIG. 3.

FIG. 11 is a flow chart illustrating an operation example of the induction heating cooker 100, and the operation example of the induction heating cooker 100 is described with reference to FIGS. 1 to 11. First, the heating target 5 is placed on a heating port of the top plate 4 by the user, and the operation unit 40 is instructed to start heating (apply the heating power). Then, in the load determining means 32, the load determination table, which indicates the relationship of the input current and the coil current, is used to determine the material of the placed heating target (pot) 5 as a load (Step ST1, see FIG. 4). Note that, in the case where it is determined that the load determination result is that the material cannot be heated or there is no load, the message is announced from the announcing means 41, and the control is performed so as not to supply the high frequency power from the drive circuit 50 to the heating coil 11*a*.

Next, in the driving frequency setting means 33, the value fd of the driving frequency f corresponding to the pot material, which is determined based on the load determination result of the load determining means 32, is determined (Step ST2). At this time, the driving frequency f is set to the frequency f=fd that is higher than the resonant frequency of the resonant circuit so that the input current does not become too large. Thereafter, the inverter circuit 23 is driven by the drive control means 31 with the driving frequency f being fixed to fd to start the induction heating operation (Step ST3). With the start of the induction heating operation by the start of the power supply, the measurement of the heating period Th by the period measuring means 35 is started.

While the induction heating operation is performed, the amount of current change ΔI is calculated at a predetermined sampling interval in the current change detecting means 34 (Step ST4). The amount of current change ΔI is detected to detect the change in temperature of the heating target 5. Then, it is determined whether or not the amount of current change ΔI is the set amount of current change ΔIref or less (Step ST5). As the heating target 5 changes from low temperature to high temperature, the amount of current change ΔI is reduced (see FIGS. 7 to 9). The change in temperature of the heating target 5 may be detected based on the change in input current, with the result that the change in temperature of the heating target 5 may be detected at high speed as compared to being detected by a temperature sensor or the like.

Then, when the amount of current change ΔI becomes the set amount of current change ΔIref or less, the heating period Th is detected in the period measuring means 35 (Step ST6).

Thereafter, the increment amount Δf of the driving frequency f is determined based on the heating period Th in the drive control means 31. The driving frequency of the inverter circuit 23 is changed from f=fd to f=fd+Δf in the drive control means 31, and reduced high frequency power is supplied from the inverter circuit 23 to the heating coil 11*a* (Step ST7, see FIGS. 8 to 10). Note that, when the amount of current change ΔI becomes the set amount of current change ΔIref or less, or when the value fd of the driving frequency f is increased by the increment amount Δf so that the driving frequency becomes f=fd+Δf, the completion of the water boiling is announced from the announcing means 41 to the user under the control of the input/output control means 36.

As described above, the driving frequency f of the power, which is to be supplied to the heating coil 11*a* after a predefined amount of current change ΔI is reached, is changed by the increment amount Δf1 or Δf2 depending on the length of the heating period Th, with the result that the induction heating cooker 100, which is easy to use and realizes energy saving, may be provided. More specifically, in a case of simply increasing to a predetermined driving frequency f when the set amount of current change ΔIref is reached as before, there has been a problem in that an optimal heat retaining state depending on the amount or the type of the content cannot be maintained. In other words, in the case where the amount of the content of the heating target 5 is large, a quantity of heat falls short to gradually reduce the temperature, which necessitates reheating. On the other hand, in the case where the amount of the content of the heating target 5 is small, excessive electric power is consumed.

Here, as shown in FIGS. 8 and 9, when the volume or the like of the content of the heating target 5 is different, the heating period Th is different even with the same driving frequency f. With this point in mind, the drive control means 31 determines the increment amount Δf in accordance with the length of the heating period Th to change the driving frequency f in retaining heat. In this manner, the electric power that is necessary and sufficient for the amount of the heating target 5 may be supplied to the heating coil 11*a*, with the result that energy may be saved efficiently.

Embodiment 2

Figure 12:
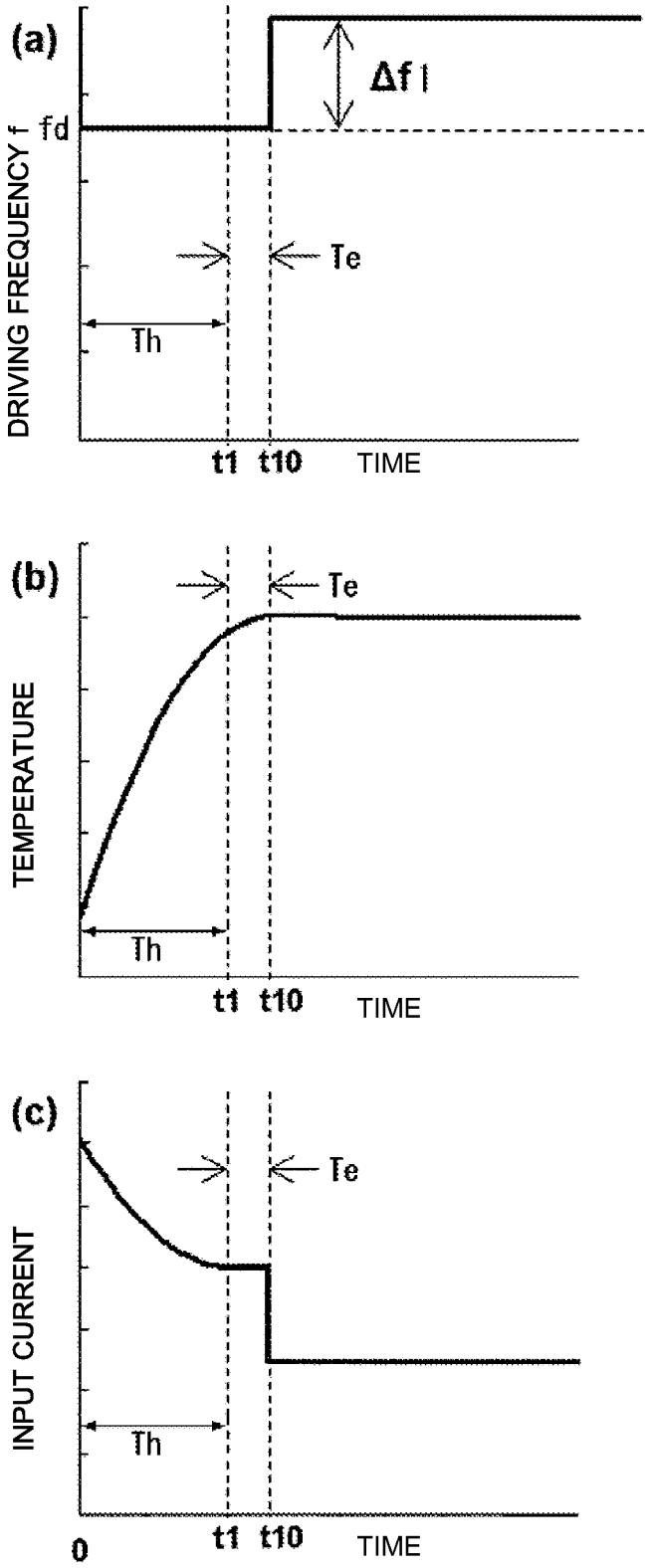
FIG. 12 is a graph showing a relationship of the temperature and the input current when the drive circuit of FIG. 3 in Embodiment 2 of the induction heating cooker according to the present invention drives at the predetermined driving frequency and the changed driving frequency.
Figure 13:
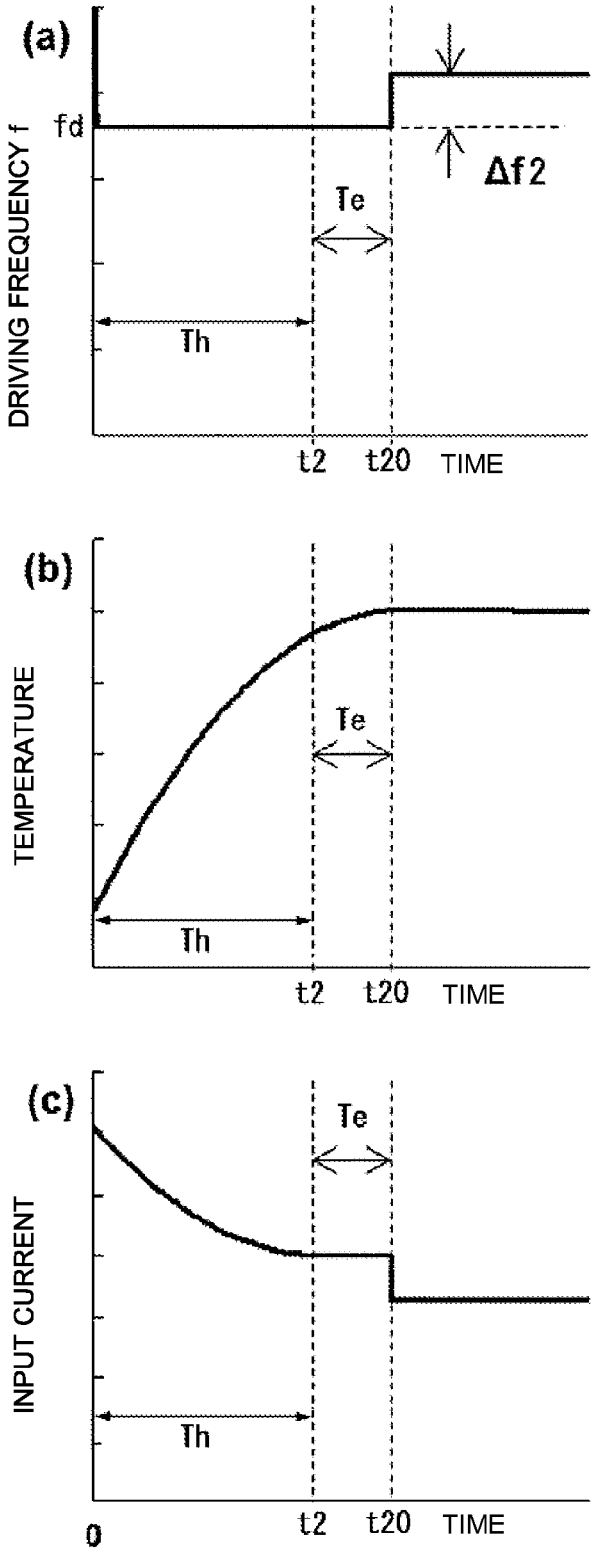
FIG. 13 is a graph showing a relationship of the temperature and the input current when the drive circuit of FIG. 3 in Embodiment 2 of the induction heating cooker according to the present invention drives at the predetermined driving frequency and the changed driving frequency.

FIGS. 12 and 13 are graphs showing Embodiment 2 of the present invention, and another operation example of the drive control means 31 of the induction heating cooker 100 is described with reference to FIGS. 12 and 13. Note that, in FIGS. 12 and 13, parts having the same components with the graphs of FIGS. 8 and 9 are indicated by the same reference symbols, and a description thereof is omitted. Control by the drive control means 31 in FIGS. 12 and 13 is different from the control by the drive control means 31 in FIGS. 8 and 9 in a change timing of the driving frequency f.

As shown in FIGS. 12 and 13, the drive control means 31 is configured to control the high frequency power to be reduced after a predetermined additional period Te has elapsed since the amount of current change ΔI has become the set amount of current change ΔIref or less. Note that, the additional period Te means a period from time t1 at which the amount of current change ΔI becomes the set amount of current change ΔIref or less to time t10 (see FIG. 12) or t20 (see FIG. 13) when the driving frequency f is changed.

Here, the additional period Te may be set in advance in the drive control means 31, or may be capable of being input from the operation unit 40 or the like, but the drive control means 31 has a function of determining a length of the additional period Te in accordance with the length of the heating period Th. More specifically, the drive control means 31 sets the additional period Te longer as the heating period Th becomes longer. Note that, the drive control means 31 may calculate the additional period Te as, for example, the additional period Te=α×the heating period Th (α is a predetermined coefficient), or may store a table indicating a relationship of the heating period Th and the additional period Te.

Therefore, when the water boiling mode is set, the driving frequency f is fixed to fd for driving, and hence the heating period Th changes depending on the amount of water put in the heating target 5. More specifically, the heating period Th becomes short in the case where the amount of water is small as in FIG. 12, and the heating period Th becomes long in the case where the amount of water is large as in FIG. 13. At this time, in the case where the heating period Th is short, the drive control means 31 sets the additional period Te short to drive the drive circuit 50 as shown in FIG. 12, and in the case where the heating period Th is long, the drive control means 31 sets the additional period Te long to drive the drive circuit 50 as shown in FIG. 13.

In this manner, the heating operation may be performed so that the entire content in the heating target 5 reaches the predetermined temperature reliably. More specifically, immediately after the amount of current change ΔI becomes the set amount of current change ΔIref or less, the temperature of the heating target (pot) 5 has reached about 100 degrees Centigrade, but water put in the heating target 5 may have uneven temperature so that water in its entirety has not reached boiling in some cases. Therefore, even after it is determined that the amount of current change ΔI has become the set amount of current change ΔIref or less and that the predetermined temperature has reached, the inverter circuit 23 is driven in the state in which the driving frequency f is fixed to fd until the additional period Te has elapsed.

Further, in the case where the amount of water is large, the temperature unevenness in water in the heating target 5 often becomes large as compared to the case where the amount of water is small, and more time is needed to reliably boil water in its entirety. Therefore, the additional period Te is set depending on the length of the heating period Th. In this manner, the energy-saving and easy-to-use induction heating cooker 100, which is capable of suppressing the wasteful power supply that is necessary for boiling and reliably boiling water in its entirety in a short period of time, may be obtained.

Embodiment 3

Figure 14:
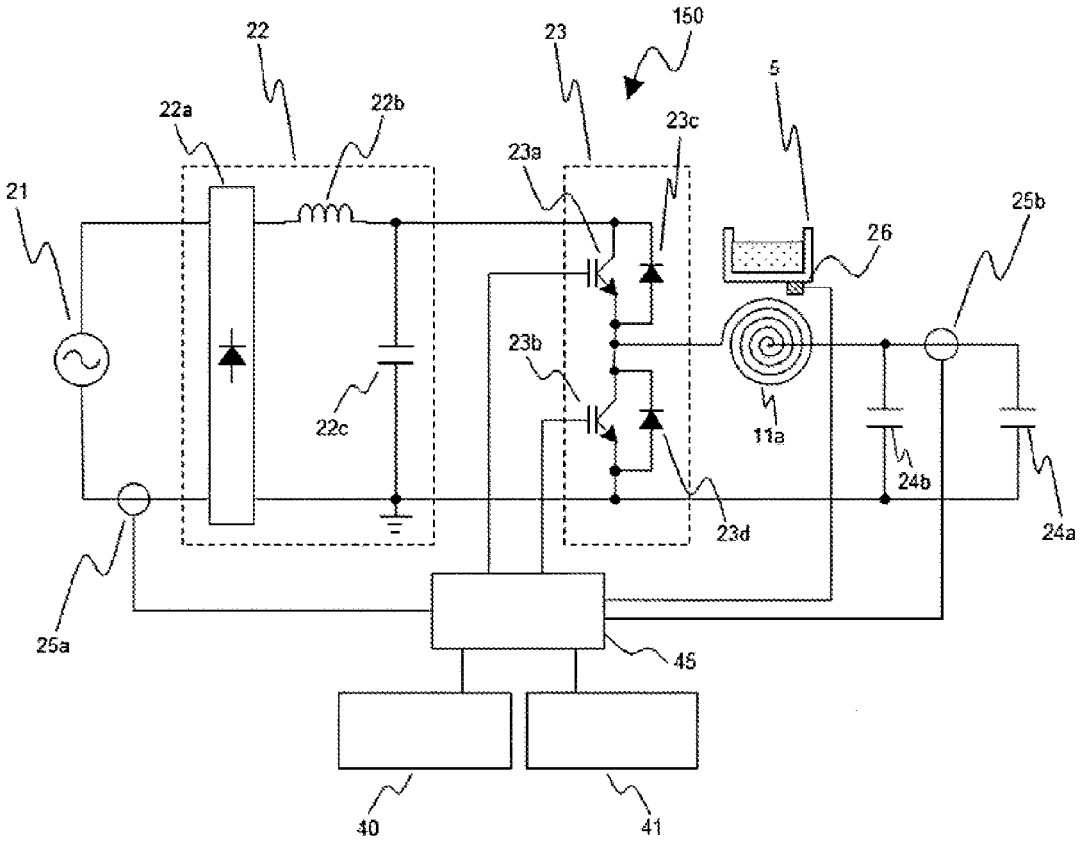
FIG. 14 is a schematic diagram illustrating Embodiment 3 of an induction heating cooker according to the present invention.

FIG. 14 is a diagram illustrating Embodiment 3 of the induction heating cooker according to the present invention, and the induction heating cooker is described with reference to FIG. 14. Note that, in a drive circuit 150 of FIG. 14, parts having the same components with the drive circuit 50 of FIG. 2 are indicated by the same reference symbols, and a description thereof is omitted. The drive circuit 150 of FIG. 14 is different from the drive circuit 50 of FIG. 2 in that the drive circuit 150 includes a plurality of resonant capacitors 24*a* and 24*b*.

More specifically, the drive circuit 150 has a configuration in which the drive circuit 150 further includes the resonant capacitor 24*b* connected in parallel to the resonant capacitor 24*a*. Therefore, in the drive circuit 150, the heating coil 11*a* and the resonant capacitors 24*a* and 24*b* form a resonant circuit. Here, capacitances of the resonant capacitors 24*a* and 24*b* are determined based on maximum heating power (maximum input power) required for the induction heating cooker. In the resonant circuit, the plurality of resonant capacitors 24*a* and 24*b* may be used to halve the capacitances of the individual resonant capacitors 24*a* and 24*b*, with the result that an inexpensive control circuit may be obtained even in the case where the plurality of resonant capacitors 24*a* and 24*b* are used.

At this time, of the plurality of resonant capacitors 24*a* and 24*b*, which are connected in parallel to each other, the coil current detecting means 25*b* is arranged on the resonant capacitor 24*a* side. Then, the electric current flowing through the coil current detecting means 25*b* becomes half the coil current flowing on the heating coil 11*a* side. Therefore, the coil current detecting means 25*b* having a small size and a small capacity may be used, a small-sized and inexpensive control circuit may be obtained, and an inexpensive induction heating cooker may be obtained.

Embodiments of the present invention are not limited to the respective embodiments described above, and various modifications may be made thereto. For example, in Embodiment 1, the case where the current change detecting means 34 detects the amount of current change ΔI of the input current detected by the input current detecting means 25*a* is exemplified, but instead of the input current, the amount of current change ΔI of the coil current detected by the coil current detecting means 25*b* may be detected. In this case, instead of the tables indicating the relationship of the driving frequency f and the input current, which are shown in FIGS. 5 and 6, a table indicating a relationship of the driving frequency f and the coil current is stored. Further, the amounts of current change ΔI of both the input current and the coil current may be detected.

Moreover, in each of the embodiments described above, the inverter circuit 23 of a half bridge type has been described, but a configuration using an inverter of a full bridge type or a single-switch resonant type or the like may be adopted.

Further, in the load determination processing in the load determining means 32, the method in which the relationship of the input current and the coil current is used has been described. However, the method of determining the load is not particularly limited, and various approaches such as a method in which a resonant voltage across both terminals of the resonant capacitor is detected to perform the load determination processing may be used.

Moreover, in each of the embodiments described above, the case where water is used as the content of the heating target 5 has been exemplified. However, the type of the content is not limited thereto, and the present invention may be applied to a case where moisture and a solid are mixed, or to oil or the like.

Moreover, in each of the embodiments described above, the method in which the driving frequency f is changed to control the high frequency power (heating power) has been described, but a method in which the ON duty (ON/OFF ratio) of the switching elements 23*a* and 23*b* of the inverter circuit 23 is changed to control the heating power may be used. More specifically, for example, the drive control means 31 stores in advance a relationship of the heating period Th and an amount of shift from an ON duty ratio (for example, 0.5) of each of the switching elements at which the maximum heating power is obtained. Then, the drive control means 31 shifts the ON duty ratio by the amount of shift corresponding to the heating period Th, which is measured by the period measuring means 35, to drive the switching elements 23*a* and 23*b*.

Further, in Embodiment 2 described above, the case where the additional period Te is set in accordance with the length of the heating period Th has been exemplified, but a period after the elapse of the heating period Th to when the amount of current change ΔI becomes zero and hence the input current becomes approximately constant may be set as the additional period Te. Also in this case, a state in which the temperature in the heating target 5 is not uneven may be realized.

Further, in each of the embodiments described above, the case where the driving frequency setting means 33 sets the driving frequency f to fd depending on the result of the load discrimination of the material by the load determining means 32 has been exemplified, but in a case where the heating target of the same material is always heated as in, for example, a rice cooker, or in other such cases, the determination may be performed by using an amount of current change ΔI obtained when driven with a preset driving frequency f.

Embodiment 4

In Embodiment 4, the drive circuit 50 according to each of Embodiments 1 to 3 described above is described in detail.

Figure 15:
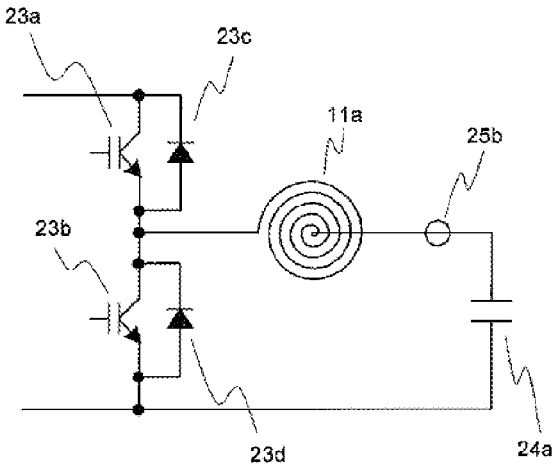
FIG. 15 is a diagram illustrating a part of a drive circuit of an induction heating cooker according to Embodiment 4.

FIG. 15 is a diagram illustrating a part of the drive circuit of the induction heating cooker according to Embodiment 3. Note that, FIG. 15 illustrates a configuration of a part of the drive circuit 50 according to each of Embodiments 1 to 3 described above.

As illustrated in FIG. 15, the inverter circuit 23 includes one set of arms including two switching elements (IGBTs 23*a* and 23*b*), which are connected in series with each other between positive and negative buses, and the diodes 23*c* and 23*d*, which are respectively connected in inverse parallel to the switching elements.

The IGBT 23*a* and the IGBT 23*b* are driven to be turned on and off with drive signals output from a controller 45.

The controller 45 outputs the drive signals for alternately turning the IGBT 23*a* and the IGBT 23*b* on and off so that the IGBT 23*b* is set to an OFF state while the IGBT 23*a* is ON and the IGBT 23*b* is set to an ON state while the IGBT 23*a* is OFF.

In this manner, the IGBT 23*a* and the IGBT 23*b* form a half bridge inverter for driving the heating coil 11*a*.

Note that, the IGBT 23*a* and the IGBT 23*b* form a "half bridge inverter circuit" according to the present invention.

The controller 45 inputs the drive signals having the high frequency to the IGBT 23*a* and the IGBT 23*b* depending on the applied electric power (heating power) to adjust a heating output. The drive signals, which are output to the IGBT 23*a* and the IGBT 23*b*, are varied in a range of the driving frequency that is higher than the resonant frequency of a load circuit, which includes the heating coil 11*a* and the resonant capacitor 24*a*, to control an electric current flowing through the load circuit to flow in a lagged phase as compared to a voltage applied to the load circuit.

Next, the operation of controlling the applied electric power (heating power) with the driving frequency and the ON duty ratio of the inverter circuit 23 is described.

Figure 16:
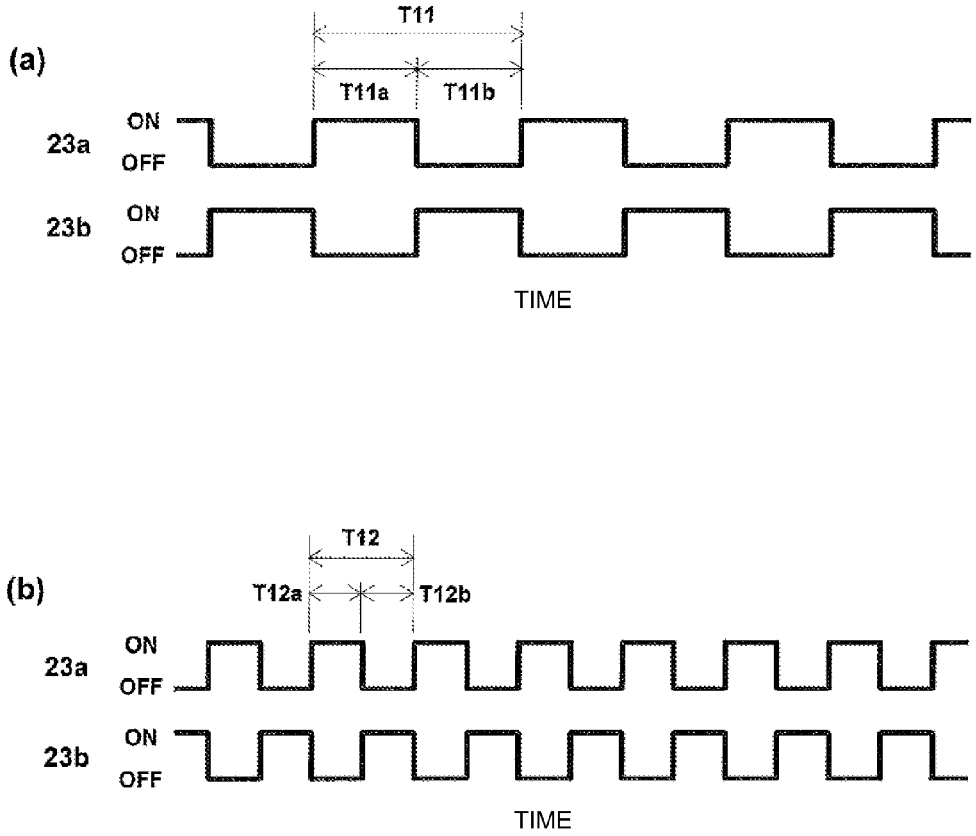
FIG. 16 is a diagram illustrating an example of drive signals of a half bridge circuit according to Embodiment 4.

FIG. 16 is a diagram illustrating an example of the drive signals of a half bridge circuit according to Embodiment 4. Part (a) of FIG. 16 is an example of the drive signals of the respective switches in a high heating power state. Part (b) of FIG. 16 is an example of the drive signals of the respective switches in a low heating power state.

The controller 45 outputs the drive signals having the high frequency, which is higher than the resonant frequency of the load circuit, to the IGBT 23*a* and the IGBT 23*b* of the inverter circuit 23.

The frequency of each of the drive signals is varied to increase or decrease the output of the inverter circuit 23.

For example, as illustrated in part (a) of FIG. 16, when the driving frequency is reduced, the frequency of the high frequency current supplied to the heating coil 11*a* approaches the resonant frequency of the load circuit, with the result that the electric power applied to the heating coil 11*a* is increased.

On the other hand, as illustrated in part (b) of FIG. 16, when the driving frequency is increased, the frequency of the high frequency current supplied to the heating coil 11*a* deviates from the resonant frequency of the load circuit, with the result that the electric power applied to the heating coil 11*a* is reduced.

Further, the controller 45 varies the driving frequency to control the applied electric power as described above, and may also vary the ON duty ratio of the IGBT 23*a* and the IGBT 23*b* of the inverter circuit 23 to control a period of time in which the output voltage of the inverter circuit 23 is applied and hence control the electric power applied to the heating coil 11*a*.

In a case of increasing the heating power, a ratio (ON duty ratio) of an ON time of the IGBT 23*a* (OFF time of the IGBT 23*b*) in one period of the drive signals is increased to increase a voltage applying time width in one period.

On the other hand, in a case of reducing the heating power, the ratio (ON duty ratio) of the ON time of the IGBT 23*a* (OFF time of the IGBT 23*b*) in one period of the drive signals is reduced to reduce the voltage applying time width in one period.

In an example of part (a) of FIG. 16, a case where ratios of an ON time T11*a* of the IGBT 23*a* (OFF time of the IGBT 23*b*) and an OFF time T11*b* of the IGBT 23*a* (ON time of the IGBT 23*b*) in one period T11 of the drive signals are the same (ON duty ratio of 50 percent (%)) is illustrated.

On the other hand, in an example of part (b) of FIG. 16, a case where ratios of an ON time T12*a* of the IGBT 23*a* (OFF time of the IGBT 23*b*) and an OFF time T12*b* of the IGBT 23*a* (ON time of the IGBT 23*b*) in one period T12 of the drive signals are the same (ON duty ratio of 50 percent (%)) is illustrated.

The controller 45 sets the ON duty ratio of the IGBT 23*a* and the IGBT 23*b* of the inverter circuit 23 to the fixed state in the state in which the driving frequency of the inverter circuit 23 is fixed in determining the amount of current change ΔI of the input current (or the coil current) as described above in Embodiments 1 to 3.

In this manner, the amount of current change ΔI of the input current (or the coil current) may be determined in a state in which the electric power applied to the heating coil 11*a* is fixed.

Embodiment 5

In Embodiment 5, the inverter circuit 23 using a full bridge circuit is described.

Figure 17:
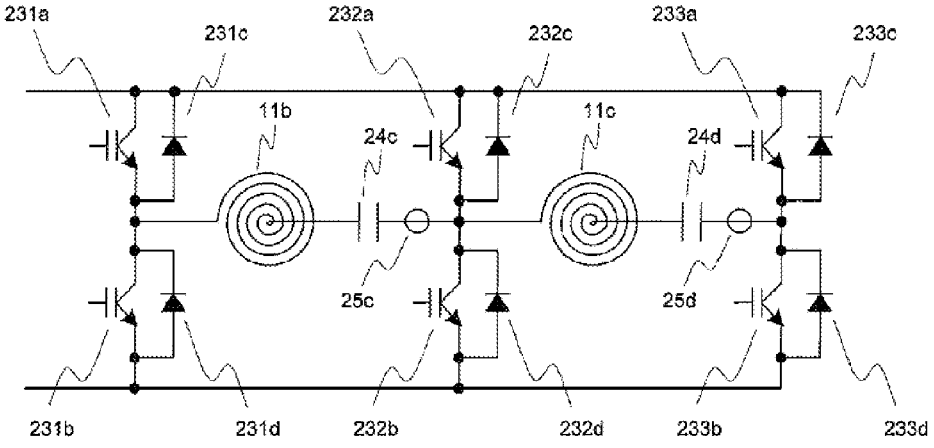
FIG. 17 is a diagram illustrating a part of a drive circuit of an induction heating cooker according to Embodiment 5.

FIG. 17 is a diagram illustrating a part of a drive circuit of an induction heating cooker according to Embodiment 5. Note that, in FIG. 17, only differences from the drive circuit 50 in Embodiments 1 to 4 described above are illustrated.

In Embodiment 5, two heating coils are provided to one heating port. The two heating coils respectively have different diameters and are arranged concentrically, for example. Hereinafter, the heating coil having the smaller diameter is referred to as "inner coil 11*b*", and the heating coil having the larger diameter is referred to as "outer coil 11*c*".

Note that, the number and the arrangement of the heating coils are not limited thereto. For example, a configuration in which a plurality of heating coils are arranged around a heating coil arranged at the center of the heating port may be adopted.

The inverter circuit 23 includes three sets of arms each including two switching elements (IGBTs), which are connected in series with each other between positive and negative buses, and diodes, which are respectively connected in inverse parallel to the switching elements. Note that, hereinafter, of the three sets of arms, one set is referred to as "common arm", and the other two sets are respectively referred to as "inner coil arm" and "outer coil arm".

The common arm is an arm connected to the inner coil 11*b* and the outer coil 11*c*, and includes an IGBT 232*a*, an IGBT 232*b*, a diode 232*c*, and a diode 232*d*.

The inner coil arm is an arm connected to the inner coil 11*b*, and includes an IGBT 231*a*, an IGBT 231*b*, a diode 231*c*, and a diode 231*d*.

The outer coil arm is an arm connected to the outer coil 11*c*, and includes an IGBT 233*a*, an IGBT 233*b*, a diode 233*c*, and a diode 233*d*.

The IGBT 232*a* and the IGBT 232*b* of the common arm, the IGBT 231*a* and the IGBT 231*b* of the inner coil arm, and the IGBT 233*a* and the IGBT 233*b* of the outer coil arm are driven to be turned on and off with drive signals output from the controller 45.

The controller 45 outputs drive signals for alternately turning the IGBT 232*a* and the IGBT 232*b* of the common arm on and off so that the IGBT 232*b* is set to an OFF state while the IGBT 232*a* is ON and the IGBT 232*b* is set to an ON state while the IGBT 232*a* is OFF.

Similarly, the controller 45 outputs drive signals for alternately turning the IGBT 231*a* and the IGBT 231*b* of the inner coil arm, and the IGBT 233*a* and the IGBT 233*b* of the outer coil arm on and off.

In this manner, the common arm and the inner coil arm form a full bridge inverter for driving the inner coil 11*b*. Further, the common arm and the outer coil arm form a full bridge inverter for driving the outer coil 11*c*.

Note that, the common arm and the inner coil arm form a "full bridge inverter circuit" according to the present invention. Further, the common arm and the outer coil arm form a "full bridge inverter circuit" according to the present invention.

A load circuit, which includes the inner coil 11*b* and a resonant capacitor 24*c*, is connected between an output point (node of the IGBT 232*a* and the IGBT 232*b*) of the common arm and an output point (node of the IGBT 231*a* and the IGBT 231*b*) of the inner coil arm.

A load circuit including the outer coil 11*c* and a resonant capacitor 24*d* is connected between the output point of the common arm and an output point (node of the IGBT 233*a* and the IGBT 233*b*) of the outer coil arm.

The inner coil 11*b* is a heating coil that is wound in a substantially circular shape and has a small outer shape, and the outer coil 11*c* is arranged in the circumference of the inner coil 11*b*.

A coil current flowing through the inner coil 11*b* is detected by coil current detecting means 25*c*. The coil current detecting means 25*c* detects, for example, a peak of an electric current flowing through the inner coil 11*b*, and outputs a voltage signal corresponding to a peak value of a heating coil current to the controller 45.

A coil current flowing through the outer coil 11*c* is detected by coil current detecting means 25*d*. The coil current detecting means 25*d* detects, for example, a peak of an electric current flowing through the outer coil 11*c*, and outputs a voltage signal corresponding to a peak value of a heating coil current to the controller 45.

The controller 45 inputs the drive signals having the high frequency to the switching elements (IGBTs) of each arm depending on the applied electric power (heating power) to adjust the heating output.

The drive signals, which are output to the switching elements of the common arm and the inner coil arm, are varied in a range of the driving frequency that is higher than a resonant frequency of the load circuit, which includes the inner coil 11*b* and the resonant capacitor 24*c*, to control an electric current flowing through the load circuit to flow in a lagged phase as compared to a voltage applied to the load circuit.

Similarly, the drive signals, which are output to the switching elements of the common arm and the outer coil arm, are varied in a range of the driving frequency that is higher than a resonant frequency of a load circuit, which includes the outer coil 11*c* and the resonant capacitor 24*d*, to control an electric current flowing through the load circuit to flow in a lagged phase as compared to a voltage applied to the load circuit.

Next, an operation of controlling the applied electric power (heating power) with a phase difference between the arms of the inverter circuit 23 is described.

Figure 18:
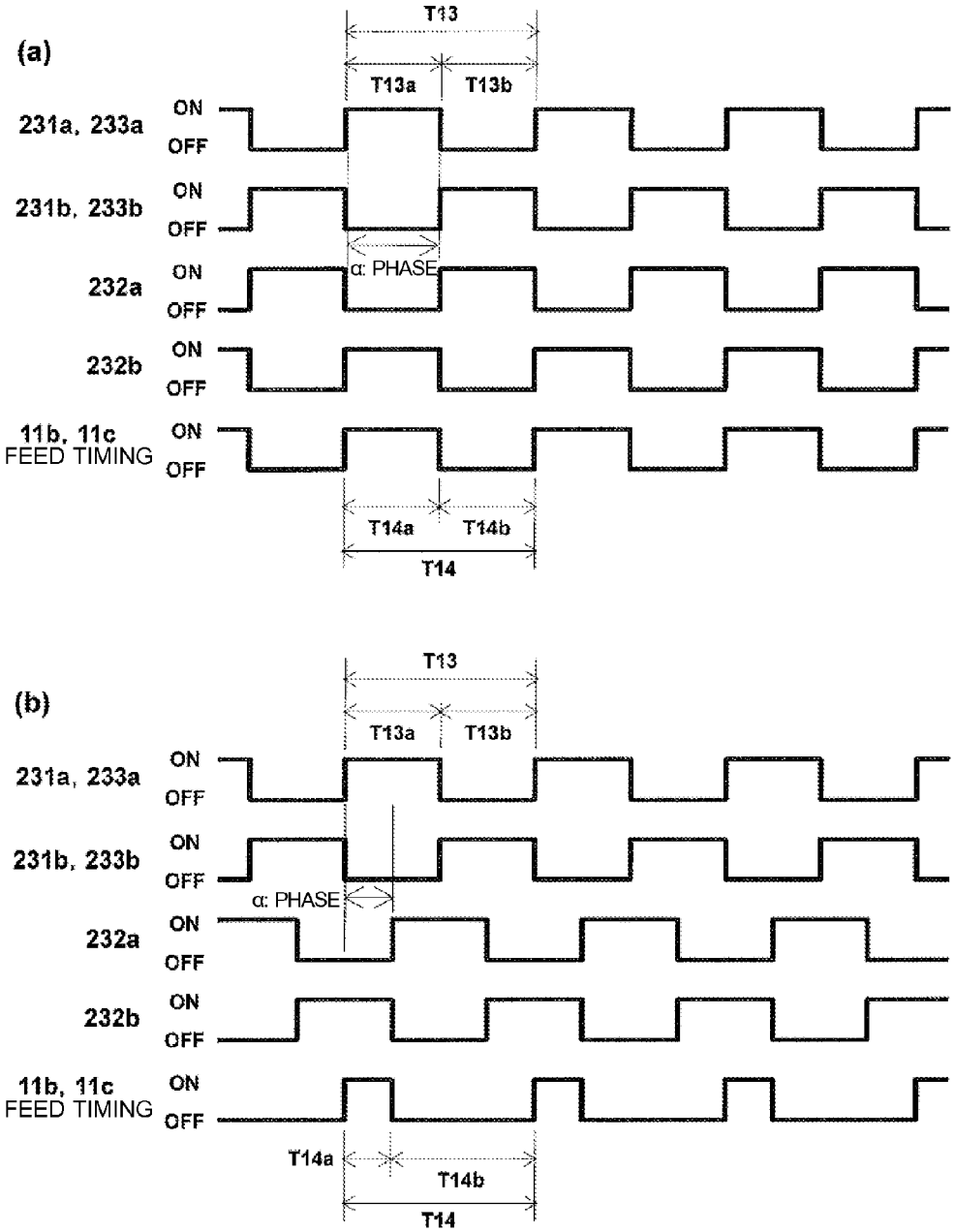
FIG. 18 is a diagram illustrating an example of drive signals of a full bridge circuit according to Embodiment 5.

FIG. 18 is a diagram illustrating an example of the drive signals of the full bridge circuit according to Embodiment 5.

Part (a) of FIG. 18 is an example of the drive signals of the respective switches and a feed timing of each of the heating coils in the high heating power state.

Part (b) of FIG. 18 is an example of the drive signals of the respective switches and a feed timing of each of the heating coils in the low heating power state.

Note that, the feed timings illustrated in parts (a) and (b) of FIG. 18 relate to a potential difference of the output points (nodes of pairs of IGBTs) of the respective arms, and a state in which the output point of the common arm is lower than the output point of the inner coil arm and the output point of the outer coil arm is indicated by "ON". On the other hand, a state in which the output point of the common arm is higher than the output point of the inner coil arm and the output point of the outer coil arm and a state of the same potential are indicated by "OFF".

As illustrated in FIG. 18, the controller 45 outputs drive signals having a high frequency that is higher than the resonant frequency of the load circuit to the IGBT 232*a* and the IGBT 232*b* of the common arm.

In addition, the controller 45 outputs drive signals that are advanced in phase relative to the drive signals of the common arm to the IGBT 231*a* and the IGBT 231*b* of the inner coil arm and the IGBT 233*a* and the IGBT 233*b* of the outer coil arm. Note that, frequencies of the drive signals of the respective arms are the same frequency, and ON duty ratios thereof are also the same.

To the output point (node of a pair of IGBTs) of each arm, depending on the ON/OFF state of the pair of IGBTs, a positive bus potential or a negative bus potential, which is an output of the DC power supply circuit, is output while being switched at the high frequency. In this manner, the potential difference between the output point of the common arm and the output point of the inner coil arm is applied to the inner coil 11*b*. Similarly, the potential difference between the output point of the common arm and the output point of the outer coil arm is applied to the outer coil 11*c*.

Therefore, the phase difference between the drive signals to the common arm and the drive signals to the inner coil arm and the outer coil arm may be increased or decreased to adjust high frequency voltages to be applied to the inner coil 11*b* and the outer coil 11*c* and control high frequency output currents and the input currents, which flow through the inner coil 11*b* and the outer coil 11*c*.

In the case of increasing the heating power, a phase a between the arms is increased to increase the voltage applying time width in one period. Note that, an upper limit of the phase a between the arms is a case of a reverse phase (phase difference of 180 degrees), and an output voltage waveform at this time is a substantially rectangular wave.

In the example of part (a) of FIG. 18, a case where the phase a between the arms is 180 degrees is illustrated. In addition, a case where the ON duty ratio of the drive signals of each arm is 50 percent (%), that is, a case where ratios of an ON time T13*a* and an OFF time T13*b* in one period T13 are the same is illustrated.

In this case, a feed ON time width T14*a* and a feed OFF time width T14*b* of the inner coil 11*b* and the outer coil 11*c* in one period T14 of the drive signals have the same ratio.

In the case of reducing the heating power, the phase a between the arms is reduced as compared to the high heating power state to reduce the voltage applying time width in one period. Note that, a lower limit of the phase a between the arms is set, for example, to such a level as to avoid an overcurrent from flowing through and destroying the switching elements in relation to the phase of the electric current flowing through the load circuit at the time of being turned on or the like.

In the example of part (b) of FIG. 18, a case where the phase a between the arms is reduced as compared to part (a) of FIG. 18 is illustrated. Note that, the frequency and the ON duty ratio of the drive signals of each arm are the same as in part (a) of FIG. 18.

In this case, the feed ON time width T14*a* of the inner coil 11*b* and the outer coil 11*c* in one period T14 of the drive signals is a time period corresponding to the phase a between the arms.

In this manner, the electric power (heating power) applied to the inner coil 11*b* and the outer coil 11*c* may be controlled with the phase difference between the arms.

Note that, in the above description, the case where both the inner coil 11*b* and the outer coil 11*c* perform the heating operation has been described, but the driving of the inner coil arm or the outer coil arm may be stopped so that only one of the inner coil 11*b* and the outer coil 11*c* may perform the heating operation.

The controller 45 sets each of the phase a between the arms and the ON duty ratio of the switching elements of each arm to a fixed state in the state in which the driving frequency of the inverter circuit 23 is fixed in determining the amount of current change ΔI of the input current (or the coil current) as described above in Embodiments 1 to 3. Note that, the other operations are similar to those of Embodiments 1 to 3 described above.

In this manner, the amount of current change ΔI of the input current (or the coil current) may be determined in a state in which the electric powers applied to the inner coil 11*b* and the outer coil 11*c* are fixed.

Note that, in Embodiment 5, the coil current flowing through the inner coil 11*b* and the coil current flowing through the outer coil 11*c* are detected by the coil current detecting means 25*c* and the coil current detecting means 25*d*, respectively.

Therefore, in the case where both the inner coil 11*b* and the outer coil 11*c* perform the heating operation, and even in a case where one of the coil current detecting means 25*c* and the coil current detecting means 25*d* cannot detect the coil current value due to a failure or the like, the amount of current change ΔI of the coil current may be detected based on a value detected by the other one.

Moreover, the controller 45 may determine each of the amount of current change ΔI of the coil current detected by the coil current detecting means 25*c* and the amount of current change ΔI of the coil current detected by the coil current detecting means 25*d*, and use the larger one of the amounts of change to perform each of the determination operations described above in Embodiments 1 to 3. Moreover, an average value of the amounts of change may be used to perform each of the determination operations described above in Embodiments 1 to 3.

Such control may be performed to determine the amount of current change ΔI of the coil current more accurately even in a case where one of the coil current detecting means 25*c* and the coil current detecting means 25*d* has low detection accuracy.

The invention claimed is:

1. An induction heating cooker, comprising:

a heating coil configured to inductively heat a heating target;

an inverter circuit configured to supply a high frequency power to the heating coil; and a controller configured to control driving of the inverter circuit with a drive signal, the controller including driving frequency setting means configured to set driving frequency of the drive signal in heating the heating target, current change detecting means configured to detect an amount of current change of one of an input current to the inverter circuit and a coil current flowing through the heating coil, drive control means configured to control the inverter circuit based on a length of a heating period from a start of power supply to the heating coil until the amount of current change of the one of the input current to the inverter circuit and the coil current flowing through the heating coil becomes a set amount of current change, which is set in advance, or less, wherein, when the current change detecting means detects the amount of current change, the controller sets, in a state in which a driving frequency of the inverter circuit is fixed, an ON duty ratio of switching elements of the inverter circuit to a fixed state.

2. The induction heating cooker of claim 1, wherein the controller further includes a load determining device configured to perform load determination processing on the heating target, and wherein the driving frequency setting means sets, based on a determination result of the load determining device, to set the driving frequency in the inverter circuit.

3. The induction heating cooker of claim 2, wherein the load determining device includes a load determination table storing a relationship of the input current and the coil current, and determines a load of the heating target based on the input current and the coil current at a time when the drive signal for determining the load is input to the inverter circuit.

4. The induction heating cooker of claim 1, wherein the drive control means changes the driving frequency based on the length of the heating period to reduce the high frequency power.

5. The induction heating cooker of claim 4, wherein the drive control means reduces an increment amount of the driving frequency as the length of the heating period becomes longer.

6. The induction heating cooker of claim 1, wherein the drive control means changes an ON duty ratio of the drive signal based on the length of the heating period to reduce the high frequency power.

7. The induction heating cooker of claim 1, wherein the drive control means performs control to reduce the high frequency power after an additional period, which is set in advance, has elapsed since the amount of current change became the set amount of current change or less.

8. The induction heating cooker of claim 7, wherein the drive control means determines a length of the predetermined additional period based on the length of the heating period.

9. The induction heating cooker of claim 1, further comprising announcing means configured to announce a state of the heating target, wherein the controller further includes input/output control means, and wherein the input/output control means is configured to control the announcing means to announce a fact that the heating of the heating target finished when the drive control means reduces the high frequency power to be supplied to the heating coil.

10. The induction heating cooker of claim 1, wherein the drive control means drives the inverter circuit while fixing the driving frequency during the heating period.

11. The induction heating cooker of claim 1, wherein the inverter circuit includes a full bridge inverter circuit including at least two arms each including two switching elements connected in series with each other, and wherein the controller sets, in a state in which driving frequency of the switching elements of the full bridge inverter circuit is fixed, a drive phase difference of the switching elements between the at least two arms and an ON duty ratio of the switching elements to a fixed state.

12. The induction heating cooker of claim 1, wherein the inverter circuit includes a half bridge inverter circuit including an arm including two switching elements connected in series with each other, and wherein the controller sets, in a state in which driving frequency of the switching elements of the half bridge inverter circuit is fixed, an ON duty ratio of the switching elements to a fixed state.

* * * * *